US005649484A

United States Patent [19]

Broghammer et al.

[11] Patent Number: 5,649,484

[45] Date of Patent: Jul. 22, 1997

[54] ELECTRONIC APPARATUS AND COMPUTER-CONTROLLED METHOD FOR ALIGNMENT CORRECTION

[75] Inventors: Reinhard Broghammer, Bammental; Gregor Flade, Meckesheim, both of Germany

[73] Assignee: Heidelberger Druckmaschinen AG, Heidelberg, Germany

[21] Appl. No.: 421,359

[22] Filed: Apr. 12, 1995

Related U.S. Application Data

[63] Continuation-in-part of Ser. No. 234,048, Apr. 28, 1994, abandoned.

[51] Int. Cl.[6] ..... B41F 13/24

[52] U.S. Cl. ..... 101/248; 101/181; 33/614

[58] Field of Search ..... 101/DIG. 36, 181, 101/183, 248; 33/614, 620, 621

[56] References Cited

U.S. PATENT DOCUMENTS

| | | | |
|---|---|---|---|
| 4,553,478 | 11/1985 | Greiner et al. | 101/181 |
| 4,827,626 | 5/1989 | Wieland | 33/614 |
| 4,998,472 | 3/1991 | Rodi et al. | 101/216 |
| 5,117,365 | 5/1992 | Jeschke et al. | 101/248 |

FOREIGN PATENT DOCUMENTS

| | | | |
|---|---|---|---|
| 0563833 | 11/1932 | Germany | 101/248 |
| 3400652 | 7/1985 | Germany | 101/248 |
| 3614578 | 11/1987 | Germany | 101/248 |
| 3633855 | 4/1988 | Germany | 101/248 |
| 3718594 | 12/1988 | Germany | 101/248 |
| 4013003 | 10/1991 | Germany | 101/248 |
| 8304219 | 12/1983 | WIPO | 101/248 |

*Primary Examiner*—Edgar S. Burr
*Assistant Examiner*—Steven S. Kelley
*Attorney, Agent, or Firm*—Nils H. Ljungman and Associates

[57] ABSTRACT

A computer interface unit of an electronic control system is configured for providing a user-oriented selection arrangement for selecting an appropriate adjustment sequence for changing the alignment of a flexible membrane on a cylinder. The interface unit can be directly connected with a computer processor unit for directing the computer processor unit in the selection of an appropriate correction algorithm for operating the control devices for carrying out the adjustment. In general, a control console can be provided with operating elements for inputting control commands, display elements for displaying a respective status, and control keys for inputting the necessary information for carrying out the control operation.

20 Claims, 18 Drawing Sheets

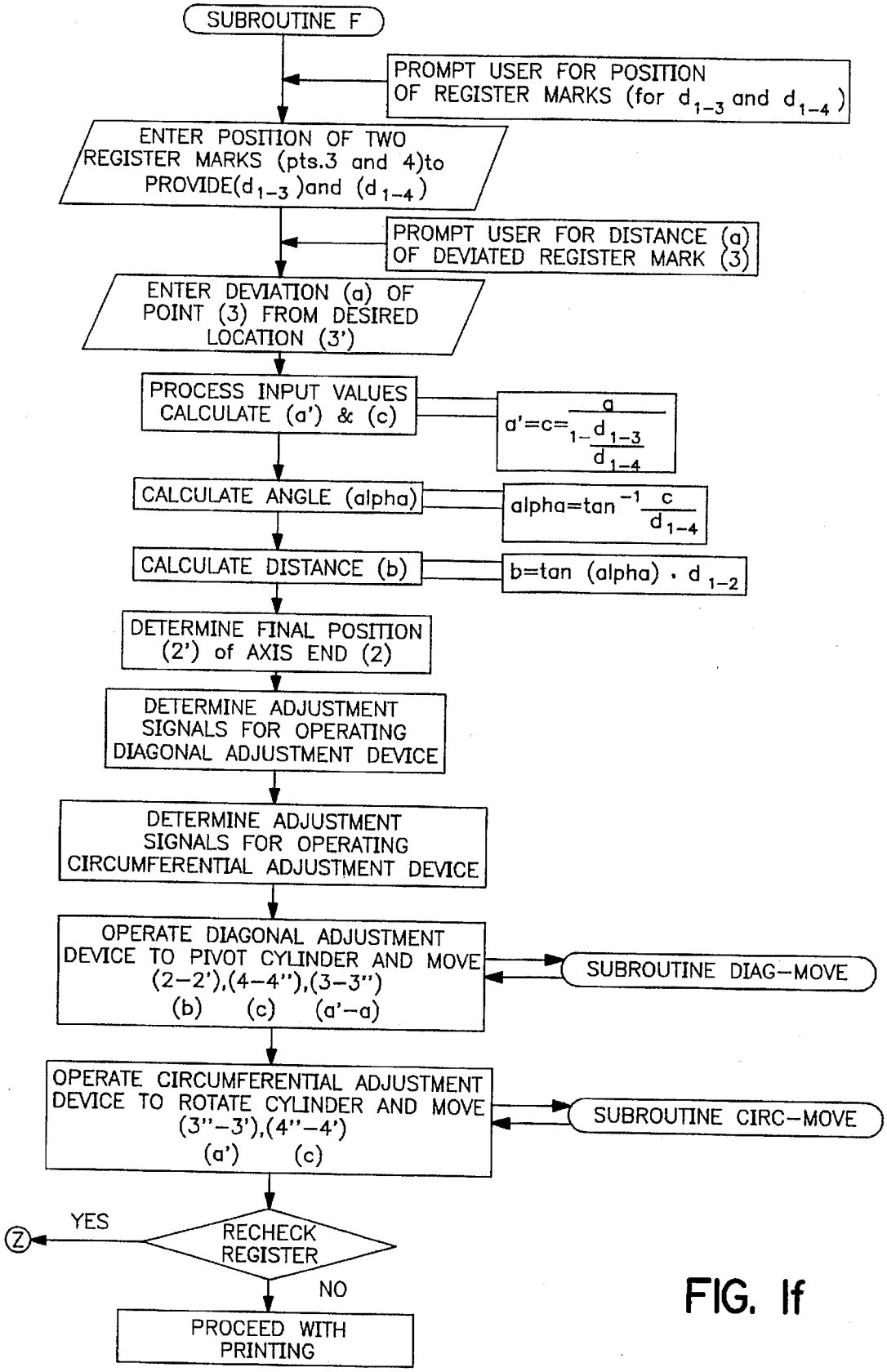
FIG. If

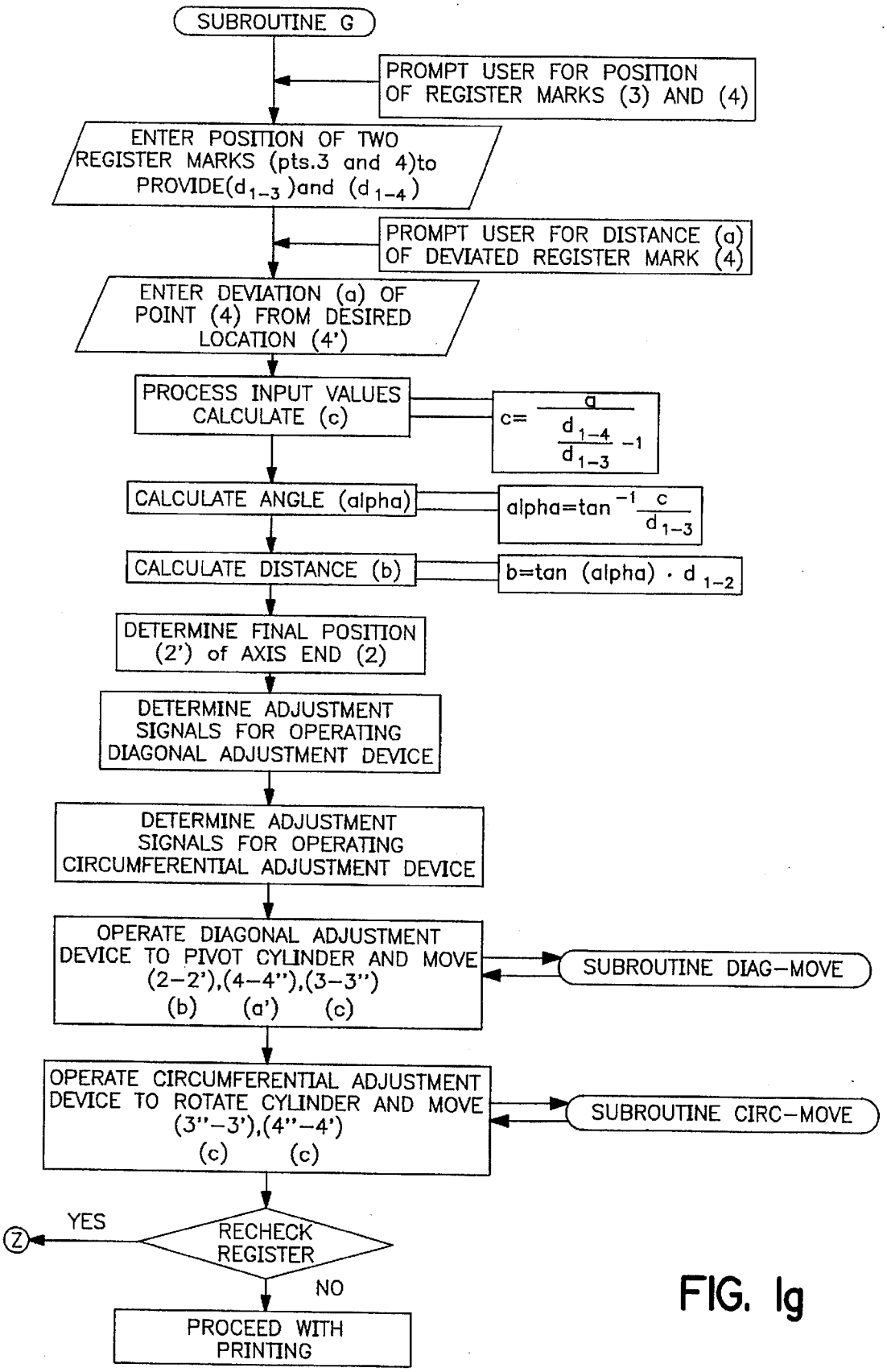
FIG. Ig

ELECTRONIC APPARATUS AND COMPUTER-CONTROLLED METHOD FOR ALIGNMENT CORRECTION

This application is a continuation-in-part of U.S. patent application Ser. No. 08/234,048, now abandoned, which was filed on Apr. 28, 1994.

BACKGROUND OF THE INVENTION

1. Field of the Invention

The invention generally relates to a computer interface unit of an electronic control system, wherein the computer interface unit is configured for providing a user-oriented selection arrangement for selecting an appropriate adjustment sequence for changing the alignment of a flexible membrane on a cylinder. The interface unit can be directly connected with a computer processor unit for directing the computer processor unit in the selection of an appropriate correction algorithm for operating the control devices for carrying out the adjustment. In general, a control console can be provided with operating elements for inputting control commands, display elements for displaying a respective status, and control keys for inputting the necessary information for carrying out the control operation.

2. Background Information

A computer processor controlled adjusting unit of the type described above is usable for adjusting the alignment of a plate cylinder which is supported in an essentially fixed manner by one of its ends, while the other end can preferably be supported in an adjustable eccentric bearing connected to an adjusting device. The plate cylinder can then be adjustable in a positive or negative sense, to thereby permit a diagonal-alignment correction. For carrying out the adjustment steps, the adjusting device can preferably be interfaced with and controlled by a computer processor unit.

One such type of electronic control device for performing various alignments, or setting the various registers, such as, diagonal register, circumferential register, and lateral register, is disclosed by the German Patent 37 18 594 A1, which corresponds to U.S. Pat. No. 4,998,472. With this disclosed device, what complicates matters is the fact that, when effecting the setting via such a register control console, the operator does not only have to perform the tilting of the cylinder, but also must additionally perform a circumferential-register correction, in particular if there is a diagonal-register deviation on the drive side.

In a printing machine, a control device can be provided to correct for the various registers of a flexible plate mounted on a plate cylinder, wherein the control device can include a control console as described above, and wherein the console can include operating elements to input control commands, display elements to display a respective status of the machine, and control keys to input values related to the register deviation in the areas of the register marks of a printed image. In a printing machine, the plate cylinder to be corrected can be firmly supported on the drive side of the machine, and can be pivot-mounted on the operating side. As such, aside from re-adjusting the plate on the cylinder, diagonal corrections can essentially only be effected by movements of the plate cylinder on the operating side of the machine.

In many printing machines, the plate cylinder is supported in an essentially fixed manner on the drive side of the machine, and on the operating side, the plate cylinder can preferably be supported in an adjustable eccentric bearing connected to an adjusting means. The plate cylinder can then be adjustable in a positive or negative sense, to thereby permit a diagonal-register correction. For this purpose the press operator has to state that there is a diagonal deviation on the printed sheet, and by pressing a respective control key, can tilt the cylinder, print a sheet, and then repeat the process as necessary, until the register marks are in correspondence with each other. This can typically require a large number of waste sheets and a rather lengthy adjusting time.

OBJECT OF THE INVENTION

On the basis of the above information it is the object of the present invention to provide an electronic control device for effecting an input diagonal-register correction readily and automatically on both sides of a plate cylinder and in both a positive and negative direction.

SUMMARY OF THE INVENTION

According to the present invention, this object can be achieved by providing control keys for effecting positive and negative correction of the diagonal register. In this regard, preferably two control keys can be provided for the operating side of the plate cylinder to effect a control action for both positive and negative correction of the diagonal register, and two additional control keys can preferably be provided for the drive side of the plate cylinder to effect a control action for both positive and negative correction of the diagonal register.

For the diagonal correction on the operating side, the cylinder bearing on the operating side can preferably be adjusted by a value calculated on the basis of the register-mark deviation measured on the operating side, and a corresponding calculation can also be made for a substantially simultaneous circumferential register correction to thereby correct the register of the plate. For the control action for the drive side deviation, the circumferential register of the plate cylinder and the cylinder bearing on the operating side can preferably be adjusted by a value calculated on the basis of the register-mark deviation measured on the drive side. In addition, as mentioned above, a corresponding calculation can also be made for a substantially simultaneous circumferential register correction to thereby correct the register of the plate.

With this solution, in accordance with the present invention, the press operator essentially only has to input the position of the measuring points into the register control console and then push an appropriate button for carrying out the correction. In other words, the operator can essentially input the position of the register mark and the value of the register deviation measured from where the mark should have been, and then simply press a respective control key. As a result thereof, the diagonal-register adjustment can be effected by pre-programmed arithmetic operations which can preferably, essentially entirely be performed by means of a computer once the required values have been input.

A diagonal register correction for a cylinder mounted as discussed above will generally also produce a change in the circumferential register, as will be explained further below. Thus, by means of the present invention, not only is the cylinder brought into the desired diagonal position, but appropriate arithmetic operations can also be programmed for essentially automatically carrying out the necessary circumferential-register correction as well. Thus, the press operator may produce register-true prints without having to run complicated tests beforehand.

For carrying out the diagonal register correction, if both register marks of a print cylinder are not located at their desired position, it might be preferable to first align one mark using the lateral and/or circumferential register adjustments, and then proceed with the process in accordance with the present invention as described briefly hereabove. Alternatively, in other possible embodiments of the present invention, the computer system could possibly permit the diagonal register correction to be performed first, or even simultaneously with any other register corrections which might need to be performed.

The above discussed embodiments of the present invention will be further detailed herebelow with reference to the accompanying figures. It should be understood that when the word "invention" is used in this application, the word "invention" includes "inventions", that is, the plural of "invention". By stating "invention", applicant does not in any way admit that the present application does not include more than one patentably and non-obviously distinct invention, and maintains the possibility that this application may include more than one patentably and non-obviously distinct invention. The Applicant hereby asserts that the disclosure of this application may include more than one invention, and, in the event that there is more than one invention, that these inventions may be patentable and non-obvious, one with respect to the other.

In summary one aspect of the invention resides broadly in an electronic system for adjusting the alignment of a membrane disposed circumferentially about a cylinder, the cylinder having a first side and a second side, and an axis of rotation extending through the first side and the second side, the cylinder defining a lateral direction along the axis of rotation, a circumferential direction rotationally about the axis of rotation, and a diagonal direction corresponding to movement of at least one of the first and second sides with respect to the other of the first and second sides, the system comprising: a computer processor unit; apparatus for inputting data into the computer processor unit, the data comprising data representative of: a location of at least two reference points of the membrane, the at least two points comprising at least a first point disposed towards the first side of the cylinder and at least a second point disposed towards the second side of the cylinder; and a deviation of at least one of the at least two points from a corresponding reference position for each of the at least two points, the deviation comprising one of: A) a deviation of the first point in a first direction away from its the corresponding reference position; B) a deviation of the first point in a second direction away from its the corresponding reference position; C) a deviation of the second point in a first direction away from its the corresponding reference position; and D) a deviation of the second point in a second direction away from its corresponding reference position; the first and second directions of deviation of the first point comprising diagonal directions of the cylinder, the second direction of deviation of the first point being substantially opposite to the first direction of deviation of the first point; the first and second directions of deviation of the second point comprising diagonal directions of the cylinder, the second direction of deviation of the second point being substantially opposite to the first direction of deviation of the second point; apparatus for selecting a deviation corresponding to one of items: A, B, C and D for directing the computer processor in determining respective adjustment signals for adjusting the cylinder; apparatus for displacing the cylinder, the apparatus for displacing comprising: apparatus for angularly displacing the axis of rotation of the cylinder to move one of the first and second sides of the cylinder with respect to the other of the first and second sides to adjust a diagonal alignment of the membrane; and apparatus for rotating the cylinder about the axis of rotation to adjust a circumferential alignment of the membrane; and apparatus for receiving the respective adjustment signals from the computer processor and for operating the apparatus for displacing as a function of the adjustment signals to adjust both the diagonal register of the printing plate and the circumferential register of the printing plate.

Another aspect of the invention resides broadly in a method for correcting the alignment of a membrane disposed circumferentially about a cylinder, the cylinder having a first side and a second side, and an axis of rotation extending through the first side and the second side, the method comprising the steps of: providing a computer processor; providing apparatus for displacing, the apparatus for displacing comprising: apparatus for angularly displacing the axis of rotation of the cylinder to adjust a diagonal register of the plate; and apparatus for rotating the cylinder to circumferentially displace the plate about the axis of rotation to adjust a circumferential register of the printing plate; providing apparatus for electrically connecting the computer processor with the apparatus for displacing for operating the apparatus for displacing to adjust both of: the diagonal register and the circumferential register; providing apparatus for inputting data regarding at least one of: a location of at least two reference points of the printing plate, the at least two reference points comprising at least a first point disposed towards the first side of the plate cylinder and at least a second point disposed towards the second side of the plate cylinder; and deviation of at least one of the at least two points from a corresponding reference position relating to each of the at least two points, the deviation comprising one of: A) a deviation of the first point in a first direction away from its the corresponding reference position; B) a deviation of the first point in a second direction away from its corresponding reference position, the second direction of deviation of the first point being substantially opposite to the first direction of deviation of the first point; C) a deviation of the second point in a first direction away from its corresponding reference position; and D) a deviation of the second point in a second direction away from its corresponding reference position, the second direction of deviation of the second point being substantially opposite to the first direction of deviation of the second point; providing apparatus for selecting one of: A, B, C and D for controlling operation of the computer processor in determining respective adjustment signals for adjusting the apparatus for displacing to adjust both the diagonal register of the printing plate and the circumferential register of the printing plate; and the method further comprising the steps of: inputting data regarding: the location of at least the first and second points; and the deviation of at least one of the at least two points from a reference position, the deviation comprising one of items A, B, C and D; selecting one of: A, B, C and D for controlling operation of the computer processor in determining respective adjustment signals for adjusting the apparatus for displacing to adjust both the diagonal register of the printing plate and the circumferential register of the printing plate; and operating the apparatus for displacing in accordance with the determined adjustment signals to adjust the diagonal register and the circumferential register of the printing plate.

More specifically, one aspect of the invention resides broadly in an apparatus for correcting the register of a printing plate disposed circumferentially about a plate cylinder of a printing press. The plate cylinder has a first side and a second side, and an axis of rotation extending through the first side and the second side. The apparatus comprises: a device for displacing, the device for displacing comprising: apparatus for angularly displacing the axis of rotation of the plate cylinder to adjust a diagonal register of the printing plate; and apparatus for circumferentially displacing the printing plate about the axis of rotation to adjust a circumferential register of the printing plate; apparatus for operating the device for displacing to adjust both of: the diagonal register and the circumferential register; apparatus for inputting data regarding at least one of: a location of at least two points of the printing plate, the at least two points comprising at least one point disposed towards the first side of the plate cylinder and at least one point disposed towards the second side of the plate cylinder; and deviation of at least one of the at least two points from a reference position, the deviation comprising one of:

A) a deviation in a first direction of a point disposed towards the first side of the plate cylinder;

B) a deviation in a second direction of a point disposed towards the first side of the plate cylinder, the second direction being opposite to the first direction;

C) a deviation in a first direction of a point disposed towards the second side of the plate cylinder; and D) a deviation in a second direction of a point disposed towards the second side of the plate cylinder; and apparatus for selecting one of: A, B, C and D for determining respective adjustment signals for adjusting the device for displacing to adjust both the diagonal register of the printing plate and the circumferential register of the printing plate.

Further, another more specific aspect of the invention resides broadly in a method for correcting the register of a printing plate disposed circumferentially about a plate cylinder of a printing press. The plate cylinder has a first side and a second side, and an axis of rotation extending through the first side and the second side. The method comprises the steps of: providing a device for displacing, the device for displacing comprising: apparatus for angularly displacing the axis of rotation of the plate cylinder to adjust a diagonal register of the printing plate; and apparatus for circumferentially displacing the printing plate about the axis of rotation to adjust a circumferential register of the printing plate; providing a device for operating the device for displacing to adjust both of: the diagonal register and the circumferential register; providing apparatus for inputting data regarding at least one of: a location of at least two points of the printing plate, the at least two points comprising at least one point disposed towards the first side of the plate cylinder and at least one point disposed towards the second side of the plate cylinder; and deviation of at least one of the at least two points from a reference position, the deviation comprising one of: A) a deviation in a first direction of a point disposed towards the first side of the plate cylinder; B) a deviation in a second direction of a point disposed towards the first side of the plate cylinder, the second direction being opposite to the first direction; C) a deviation in a first direction of a point disposed towards the second side of the plate cylinder; and D) a deviation in a second direction of a point disposed towards the second side of the plate cylinder; providing apparatus for selecting one of: A, B, C and D for determining respective adjustment signals for adjusting the device for displacing to adjust both the diagonal register of the printing plate and the circumferential register of the printing plate; and the method further comprising the steps of: inputting data regarding: a location of at least two points of the printing plate, the at least two points comprising at least one point disposed towards the first side of the plate cylinder and at least one point disposed towards the second side of the plate cylinder; and deviation of at least one of the at least two points from a reference position, the deviation comprising one of:

A) a deviation in a first direction of a point disposed towards the first side of the plate cylinder;

B) a deviation in a second direction of a point disposed towards the first side of the plate cylinder, the second direction being opposite to the first direction;

C) a deviation in a first direction of a point disposed towards the second side of the plate cylinder; and D) a deviation in a second direction of a point disposed towards the second side of the plate cylinder; selecting one of: A, B, C and D for determining respective adjustment signals for adjusting the device for displacing to adjust both the diagonal register of the printing plate and the circumferential register of the printing plate; and operating the device for displacing in accordance with the determined adjustment signals to adjust the diagonal register and the circumferential register of the printing plate.

BRIEF DESCRIPTION OF THE DRAWINGS

Further details, and explanations of the present invention are schematically illustrated in the accompanying drawings, in which:

FIGS. 1*a*–1*h* show flow charts of subroutines labelled in FIG. 1;

DESCRIPTION OF THE PREFERRED EMBODIMENTS

Figure 7:
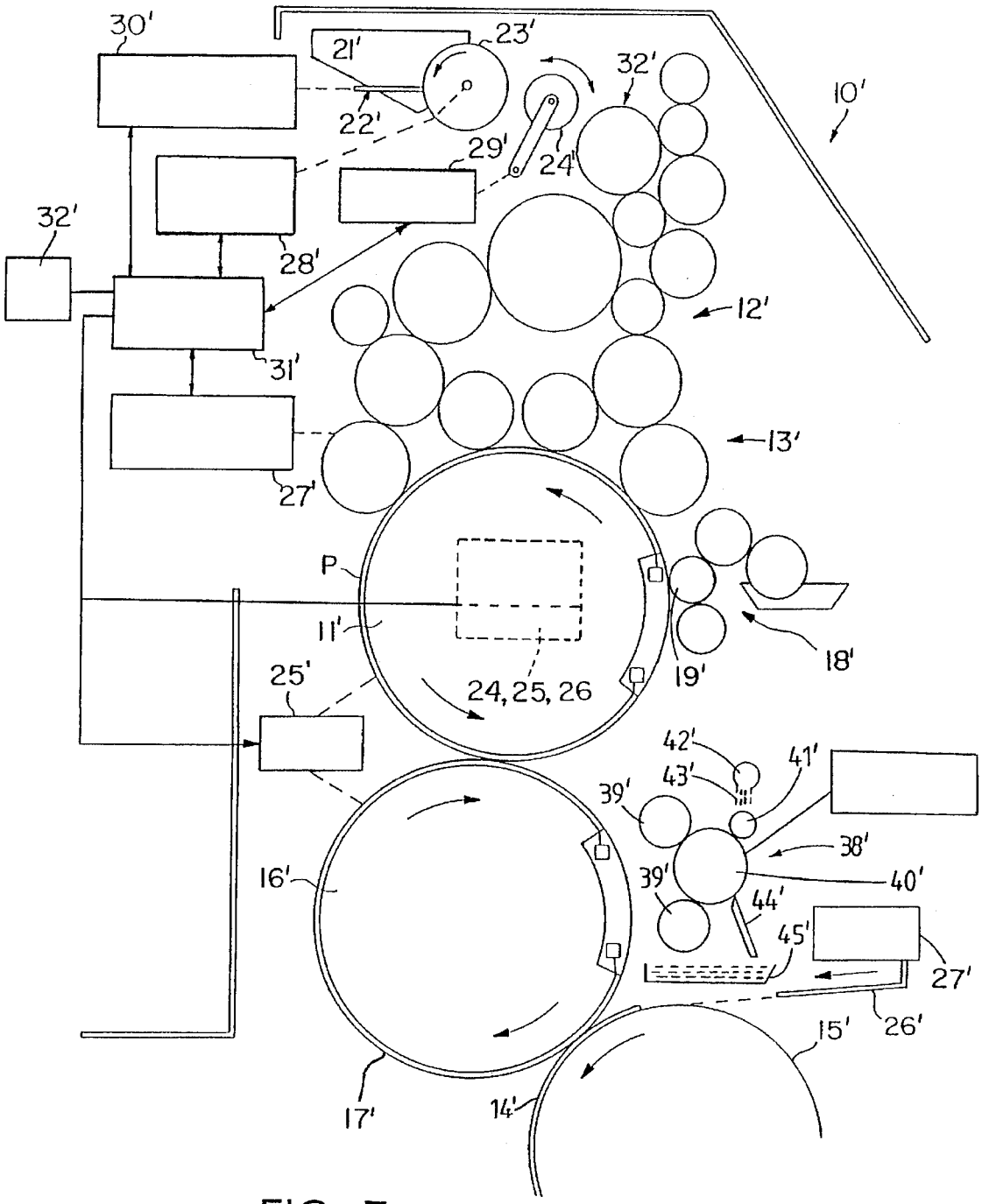
FIG. 7 depicts a typical printing stand of a printing press and the components thereof.

In printing machines using printing plates (P) mounted on cylinders 11', for example, such as the printing stand 10' depicted in FIG. 7, several such print stands 10' can be provided, each for printing a different color, i.e., one for red, one for yellow, etc. Thus, separate color images are formed by separate units of the machine, wherein the final printed image is a composite of the different printed colors. Thus, it can be of utmost importance that all patterns be in substantially perfect registration, or else blurred or distorted patterns will be produced on the printed sheets. As shown in FIG. 8, for aligning the printing plates (P) of the various print stands 10', it can be advantageous to provide at least two registration marks 50*a*', 50*b*' on each plate, in addition to the image pattern 51' The registration marks 50*a*', 50*b*' can then be printed along with the image of the printing plate.

The registration marks 50*a*', 50*b*' of one plate (P) can be precisely aligned with the registration marks on the others of the plates, in relation to the images of the plates, so that the operator of the printing press can then relatively easily determine if the plates are all aligned properly. In this regard, when the registration marks 50*a*', 50*b*' printed by the various plates are all aligned, the printed images will also be aligned, and when a register mark does not fall into alignment with other register marks, at least the plate which printed the non-aligned register mark will need to be register-corrected.

Conventional presses can preferably have, in each unit, a side register and a circumferential register for adjusting the position of the plate in the circumferential and side directions, i.e., lateral and transverse directions. In addition, conventional presses can also have some means for making minor angular adjustments for a plate if, for example, the plate has been installed on the cylinder in a skewed or canted position. For printing presses in which the plate cylinder is rigidly fixed in position on the drive side of the press, and is adjustable via an eccentric bearing on the operating, or service side of the press, one manner in which such angular adjustments can be done, is by adjusting the mounting of the plate cylinder on the operating side of the press to an inclined position in relation to the angle of the inclined or skewed position of the plate.

Figure 1:
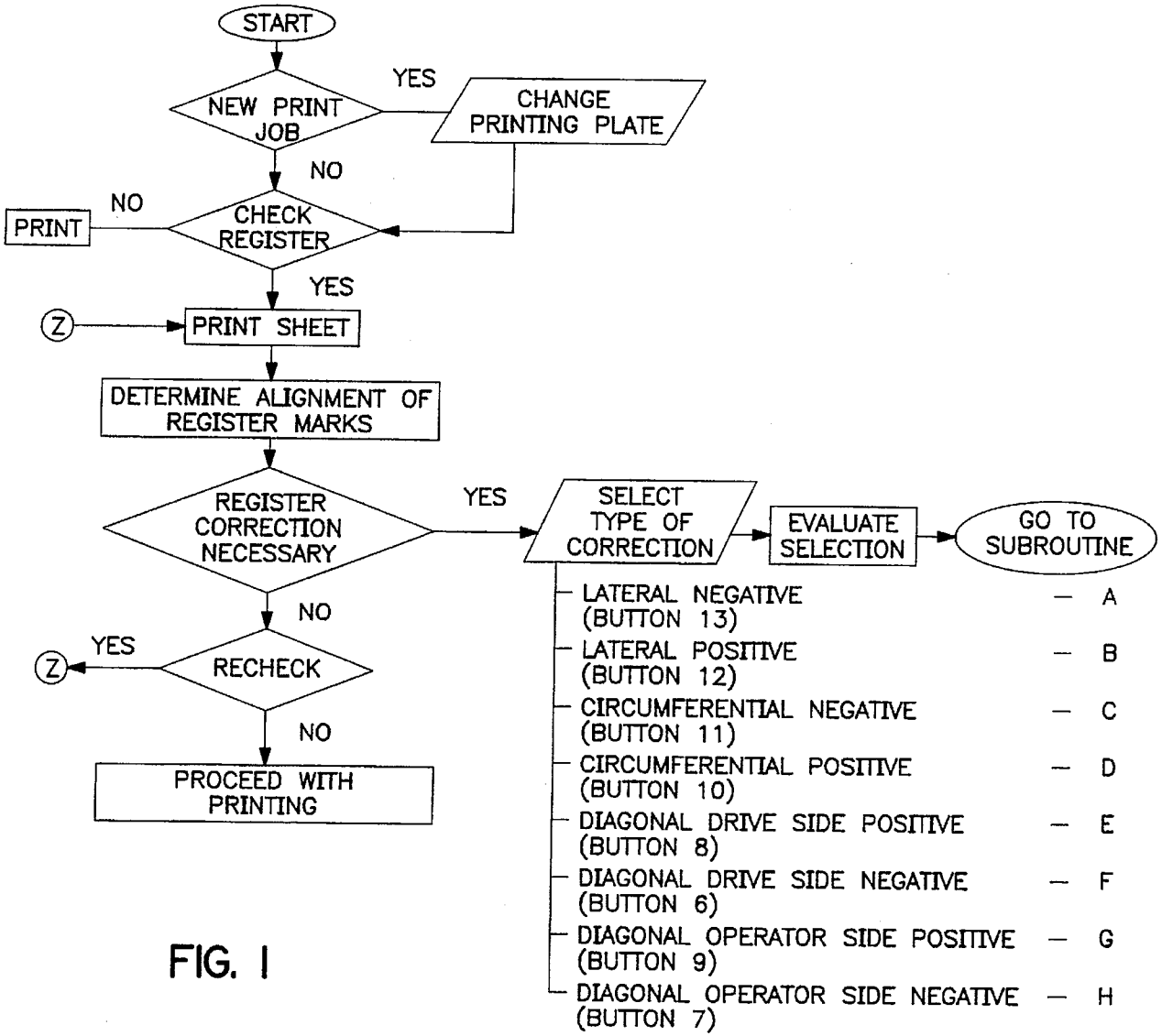
FIG. 1 shows a sample flow chart depicting process steps in accordance with one embodiment of the present invention.
Figure 1A:
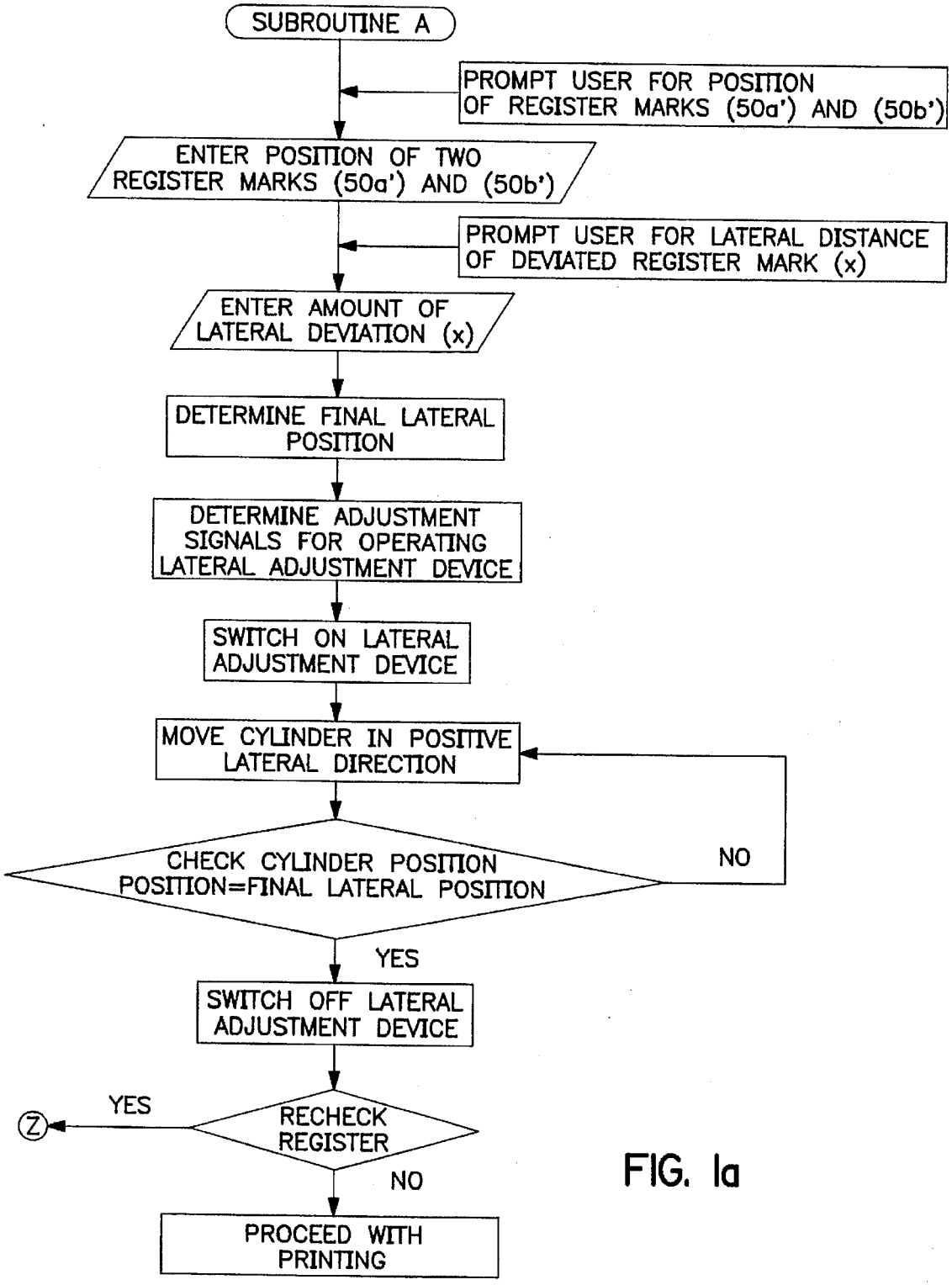
Figure 1B:
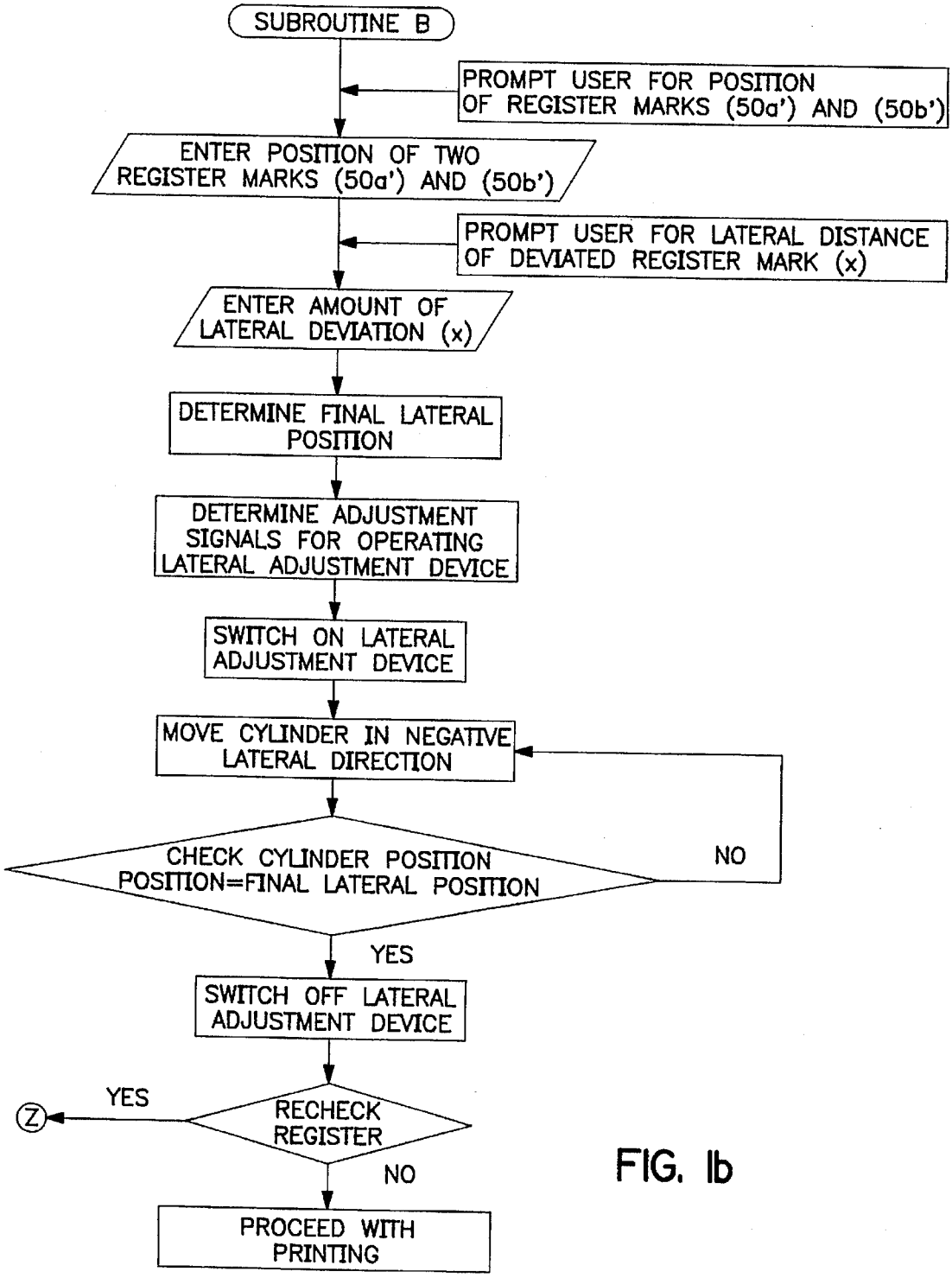
Figure 1C:
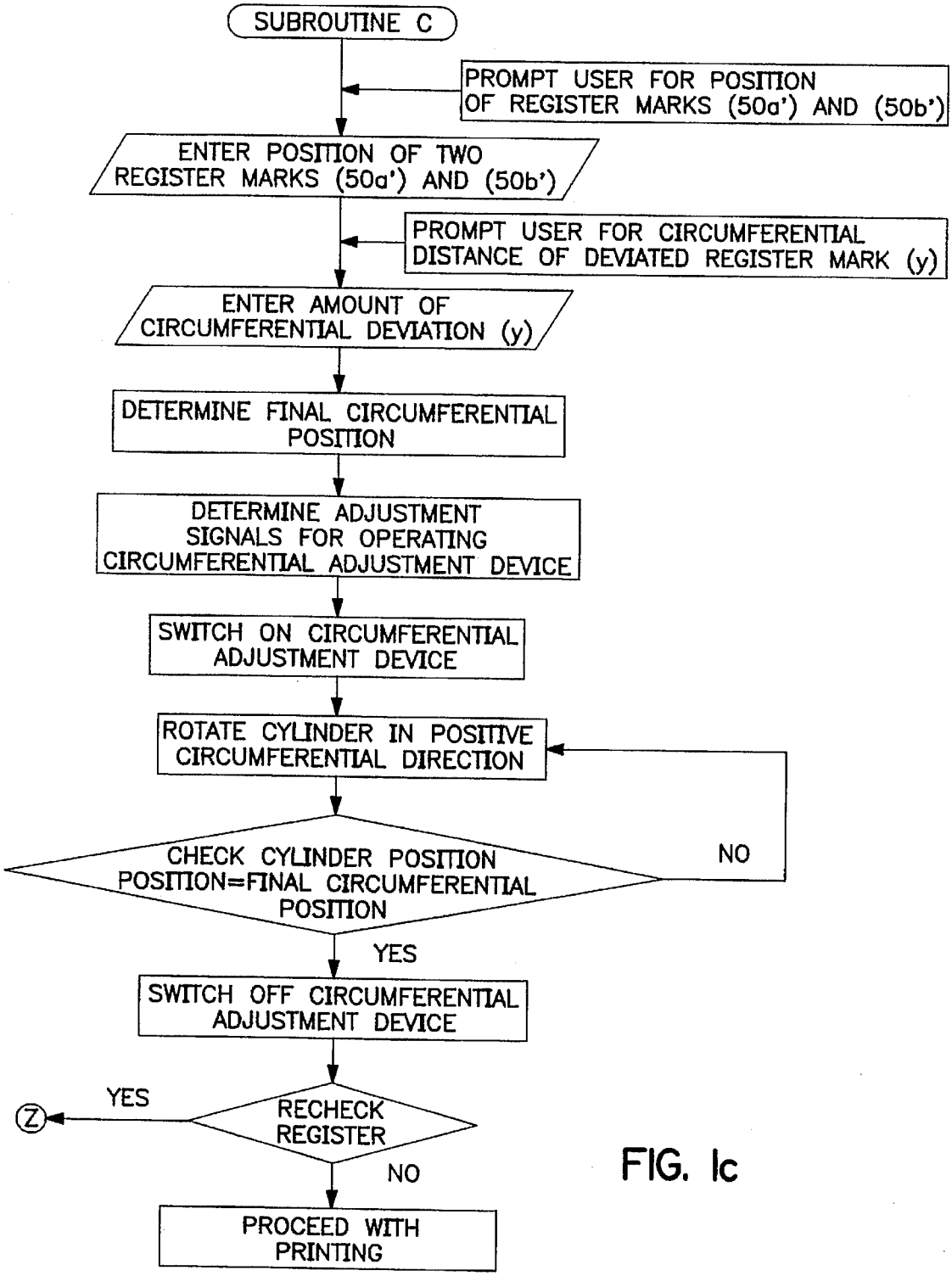
Figure 1D:
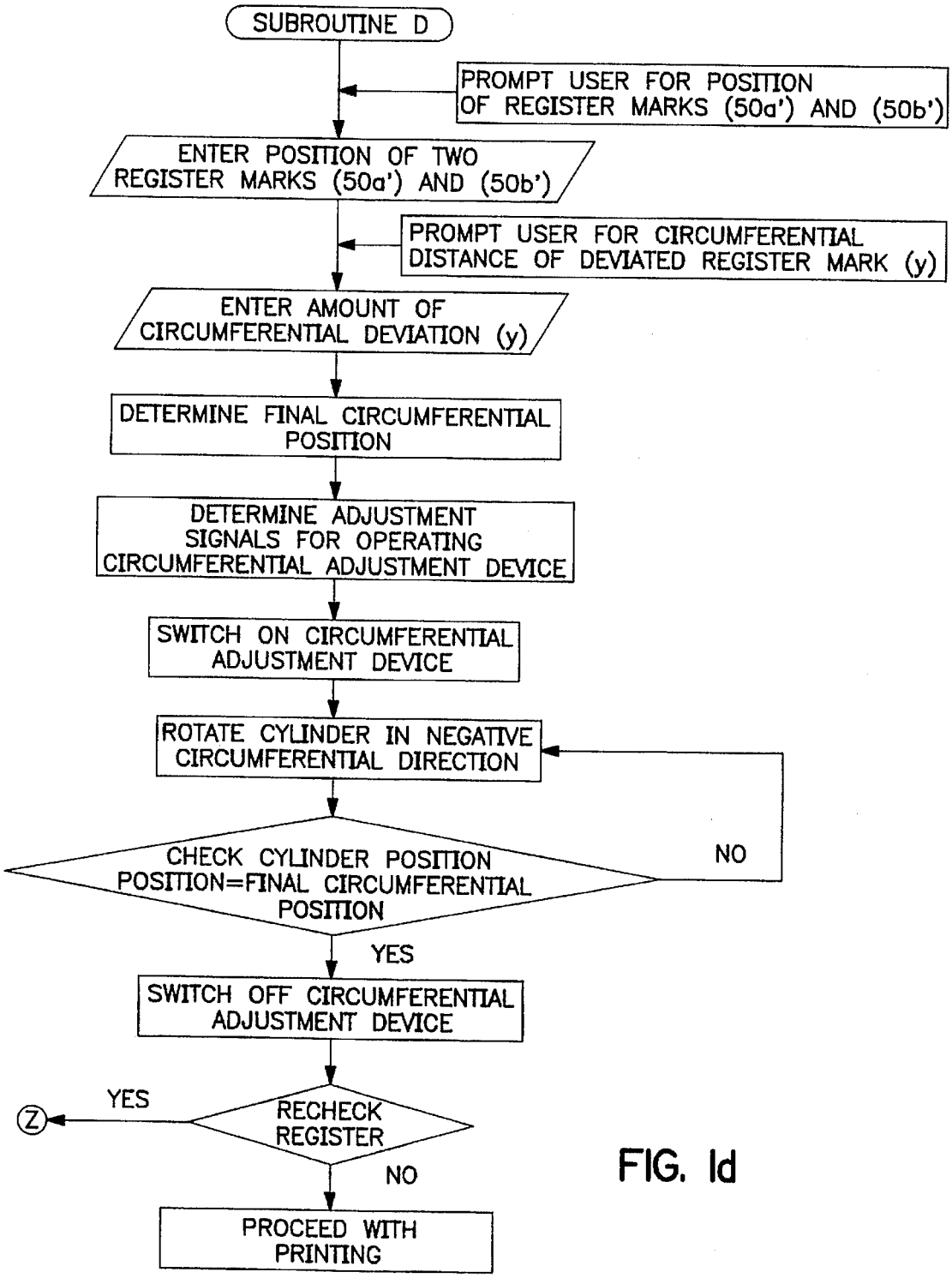

The flow chart of FIG. 1*a* depicts one general representation of a possible mode of conducting a register correction of a printing plate. Typically, a register correction could only be necessary after installing a new printing plate for a new print job, however, it may be beneficial to check the register periodically during lengthy print runs to ensure that the printing plates remain in register with one another. To check the register, the operator could essentially run only one sheet through the press to be printed upon by each of the printing stands 10'. After running the print, the image could be observed to determine if the register marks from each of the units are in alignment with one another. If the marks are aligned, printing could essentially immediately commence, otherwise a corrective action would need to be taken.

Figure 8A:
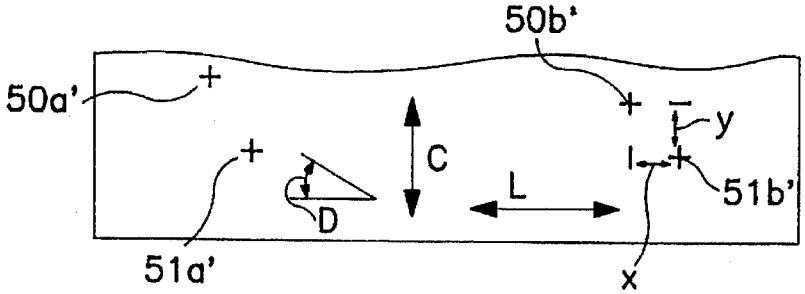
FIG. 8*a* shows a depiction of register mark deviations.
Figure 8:
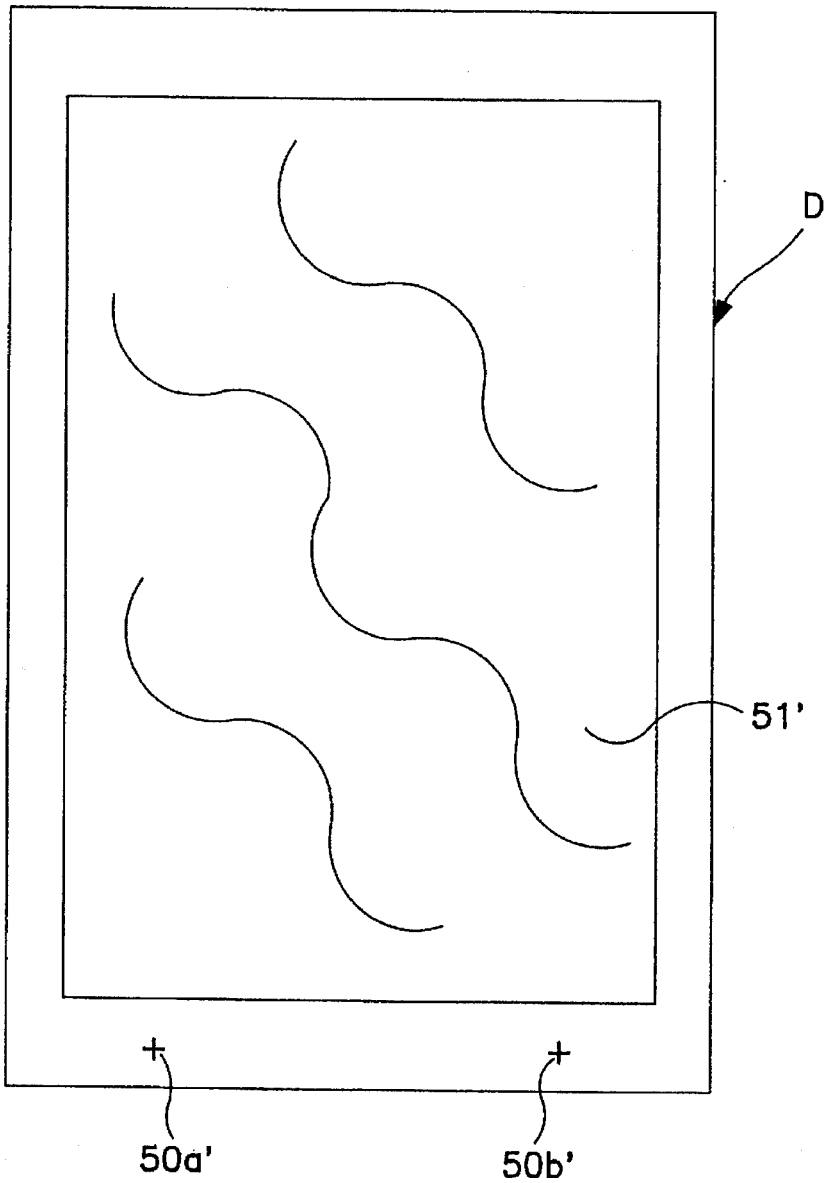
FIG. 8 depicts a printing plate and the register marks thereon.

At this juncture, the operator would then need to make a decision as to what type of register correction is necessary (see FIG. 8*a*, i.e., lateral (L)—side-to-side, circumferential (C) —rotationally about the cylinder, or diagonal (D)—angularly on the cylinder).

In any case, however, in at least one possible embodiment of the present invention, it might be preferable to at least line up one register mark first, and then continue with additional corrections as necessary. To line up at least one of the register marks, preferably lateral and circumferential register corrections can be performed first. As indicated in FIG. 8*a*, both register marks 50*a*' and 50*b*' are incorrectly aligned with the marks 51*a*' and 51*b*'. In essence, there are lateral, circumferential and diagonal register errors shown. In at least one possible embodiment of the invention, to correct the register errors depicted in FIG. 8*a*, before a diagonal correction is performed, it could be preferable to perform a lateral correction (distance—x) followed by a circumferential (distance—y), or alternatively, a circumferential followed by a lateral, to bring one register mark, i.e. mark 50*b*', into register with its reference point, i.e. point 51*b*'.

Figure 3:
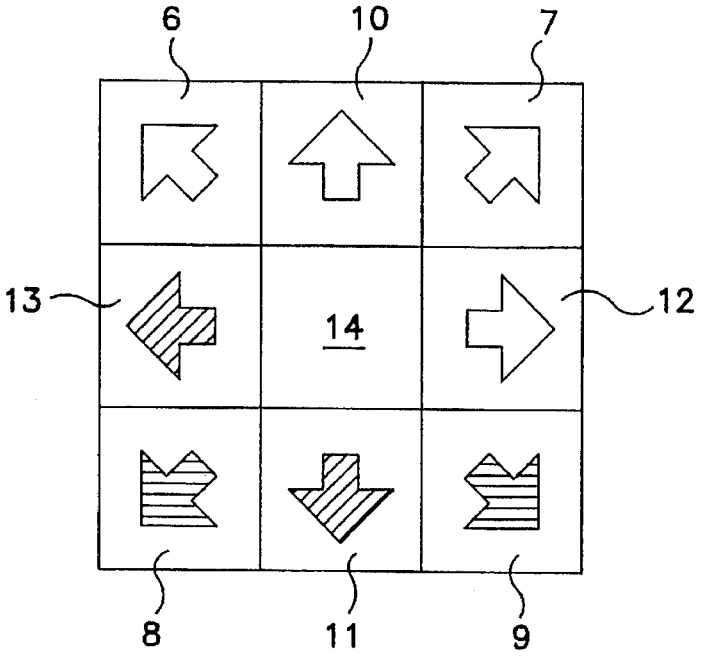
FIG. 3 shows the control keys via which the diagonal register corrections can be effected.

If one wanted to perform such a correction to bring one register point into position, to effect such a register correction, the operator could select and press an appropriate control button of a keypad, such as the keypad depicted in FIG. 3, in this case: button 13 for a leftward or negative lateral movement; button 12 for a rightward or positive lateral movement; button 10 for a positive rotational movement; or button 11 for a negative rotational movement. Each of these corresponding buttons could be electrically connected with a computer microprocessor 19 (see FIGS. 4 and 4*a*) to direct, or control the computational process of the computer microprocessor 19. Such a computer microprocessor which would be able to perform such calculations and operations etc., would essentially be known in the art as discussed further hereinbelow. Representative flow charts for each of these processes are respectively outlined in FIGS. 1*a*–1*h*.

After selecting and pressing the desired button the operator could then be prompted for entry of a deviation distance. Then, after entering the appropriate measured value, either measured manually, directly off of the printed sample, or input automatically as will be discussed further herebelow with a data entry system, the computer processor could determine the amount of movement necessary in the corresponding direction to make the desired register adjustment. The computer processor could then operate the appropriate correction device 24 or 26, in FIGS. 4 and 4*a*, for respective circumferential and/or lateral corrections, to thereby bring the cylinder into register. A new sample sheet could then be printed to determine if the register of all of the cylinders are correct. Systems for carrying out such lateral and circumferential register corrections are generally also known as set forth further hereinbelow.

Instead of, or in addition to the above briefly discussed procedures for the lateral and circumferential register corrections, a diagonal correction might also be necessary. The various types of diagonal register correction will now be set forth with reference to FIGS. 2*a*–2*d*, 6*a* and 6*b*, and in conjunction with the flow charts of FIGS. 1*e*–1*h*.

Figure 2A:
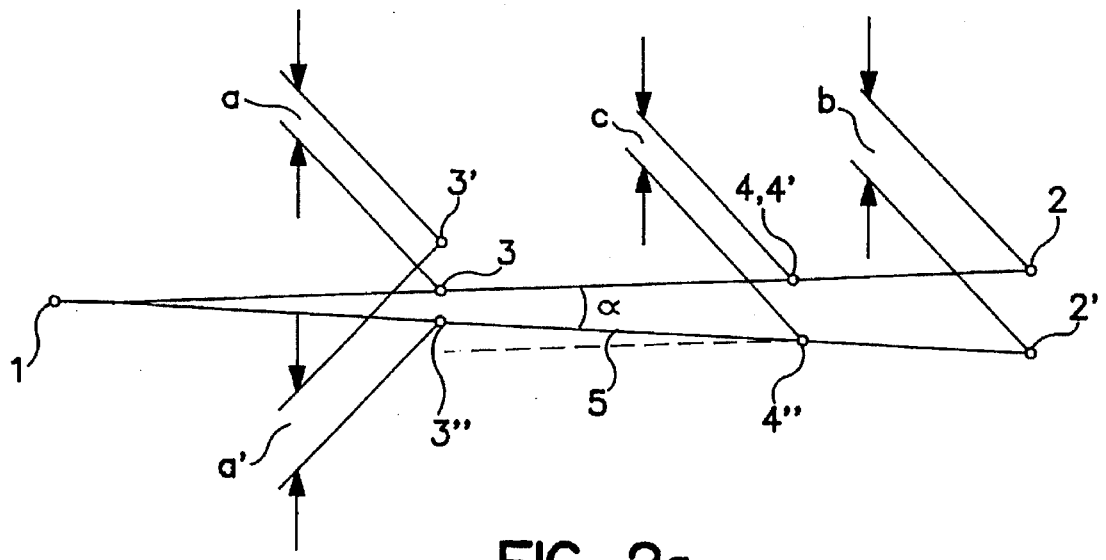
FIG. 2*a* shows a positive diagonal register deviation on the drive side.

The scheme represented in FIG. 2*a* shows a center of rotation 1, on the drive side of a press. In essence, this center of rotation 1 can be considered to be a substantially fixed point, wherein the plate cylinder can preferably be pivoted in its bearing about this center of rotation 1. A second point of rotation 2, preferably provided on the operating side of the machine, is also present in the bearing of the plate cylinder. As discussed previously, the bearing of the plate cylinder on the operating side can preferably be an eccentric bearing which can preferably allow for pivoting of the plate cylinder with respect to the drive side.

Figure 1E:
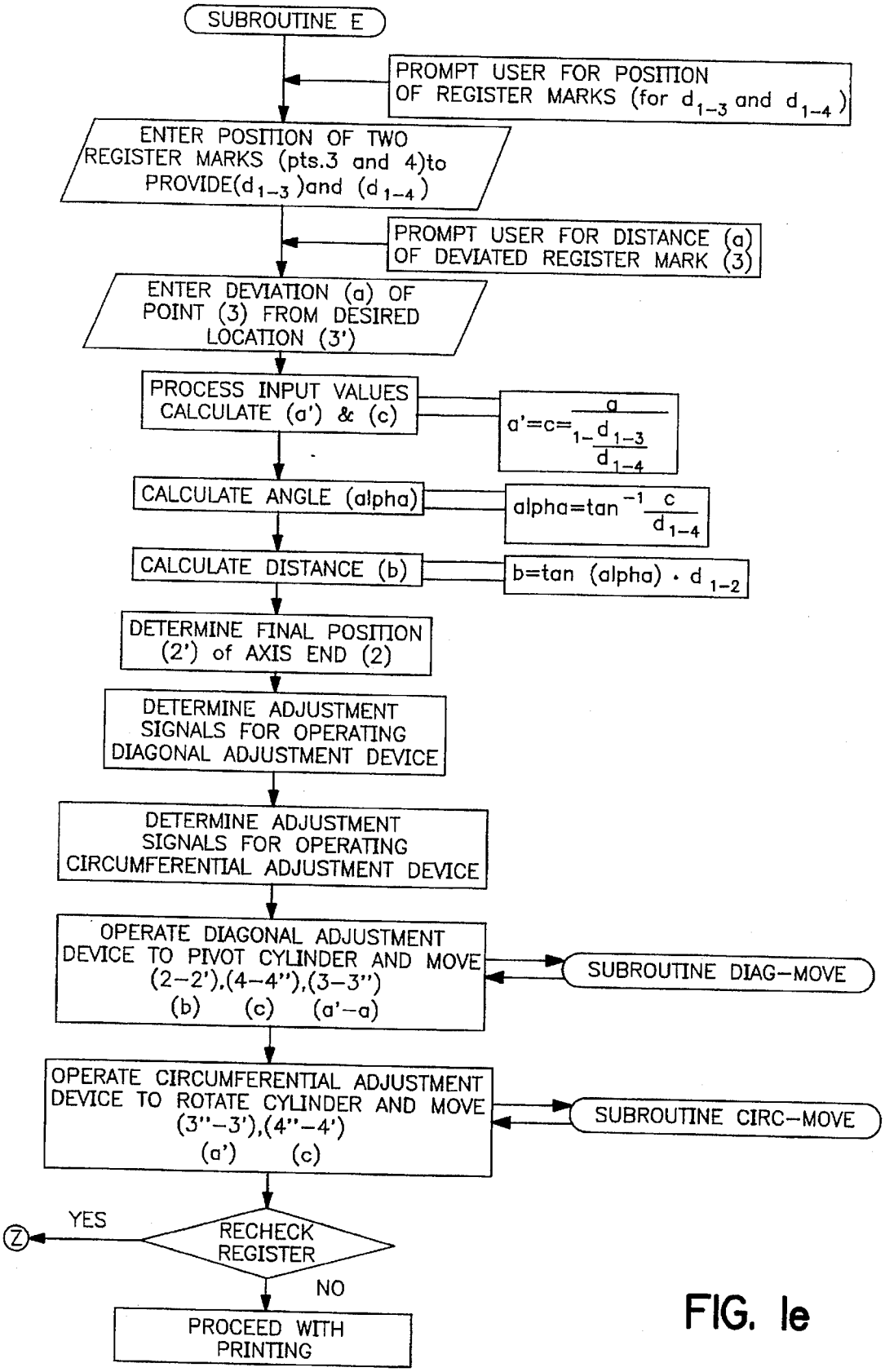
Figure 1H:
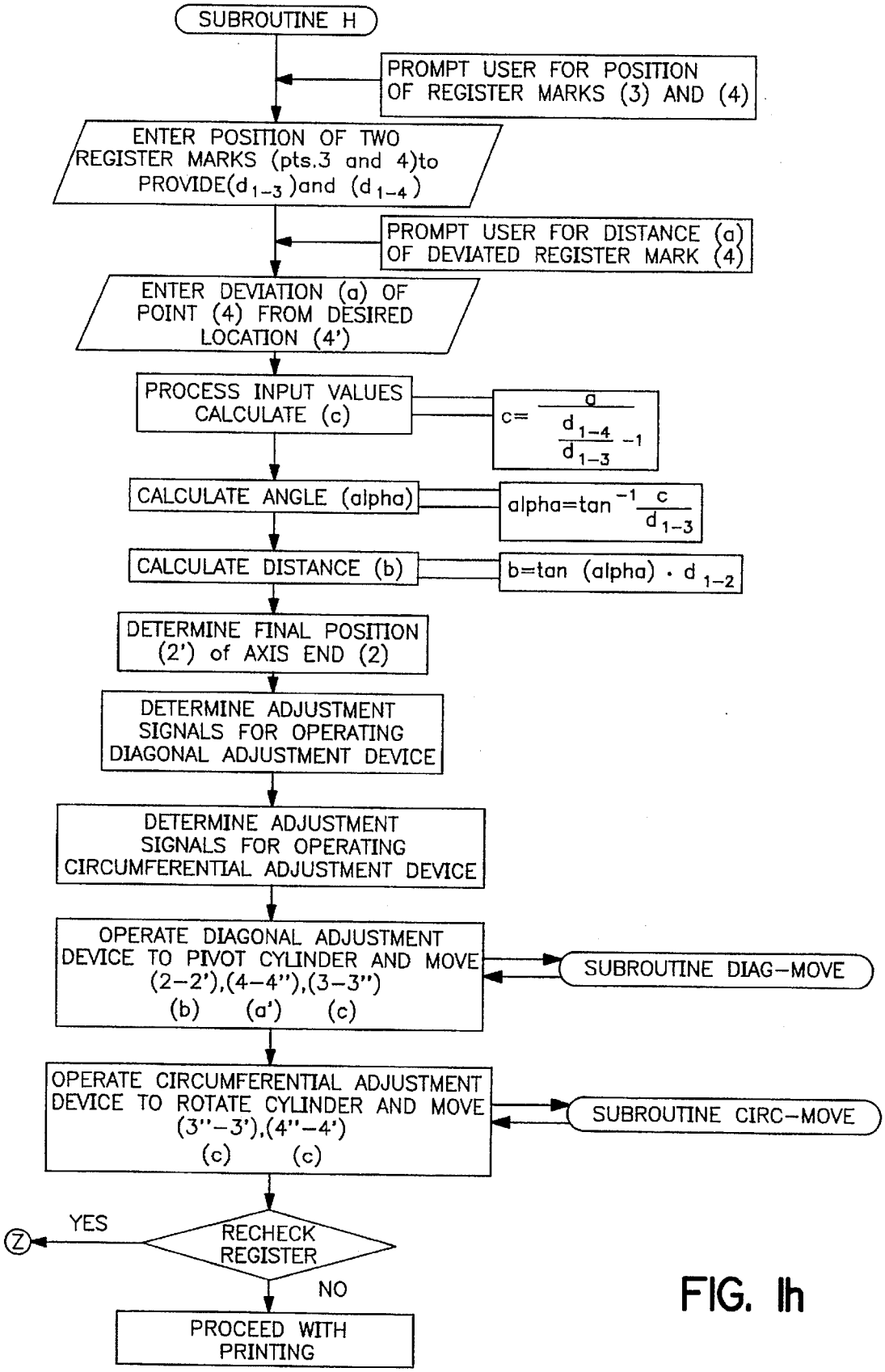
Figure 2B:
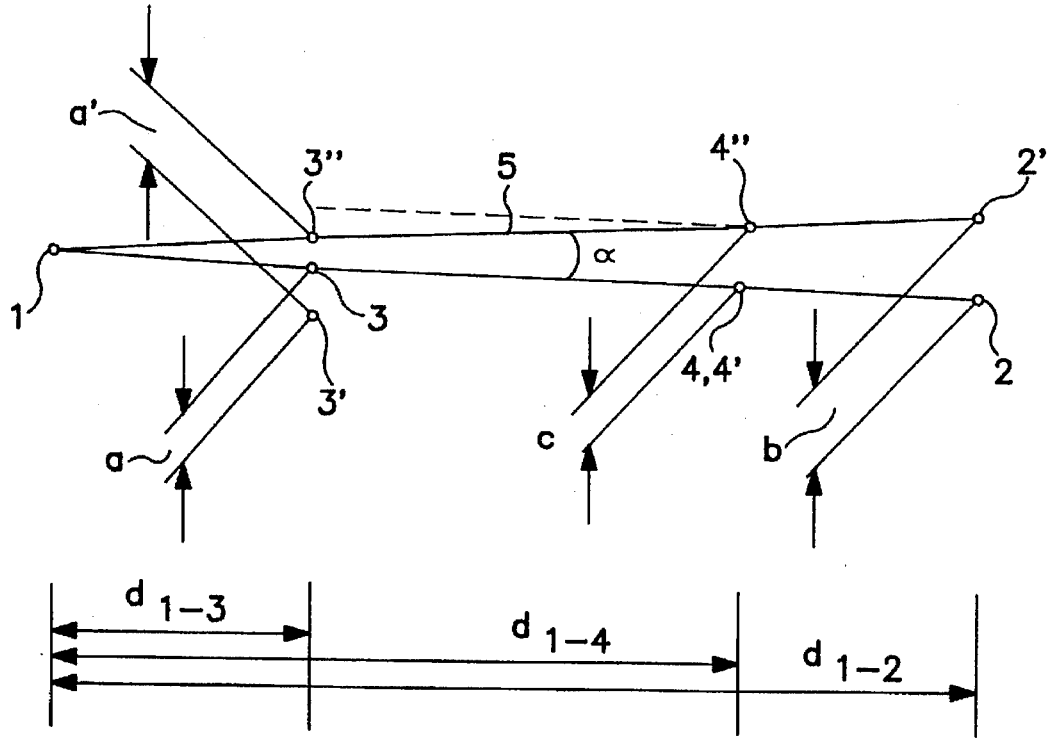
FIG. 2*b* shows a negative diagonal register deviation on the drive side.

In the scheme as depicted in FIG. 2*a*, which corresponds with the flow chart of FIG. 1*e*, a positive diagonal register deviation on the drive side is illustrated. In other words, the mark 4 is disposed at the desired location of 4', while the mark 3 is disposed below, or negative to the desired location 3'. Under such a situation, the press operator can determine the lateral position of the register mark 3 on the drive side, as well as the lateral position of the register mark 4 on the operating side relative to the respective center of rotation, and can input the positions into the device for a correction of the diagonal register. The lateral positions of the marks 3 and 4 would typically correspond to the distances $d_{1-3}$ and $d_{1-4}$, respectively, as shown in FIG. 2*b*. The distance $d_{1-2}$ would also generally be known for a cylinder, i.e. the cylinder length, and would generally be a value stored in memory.

Figure 4:
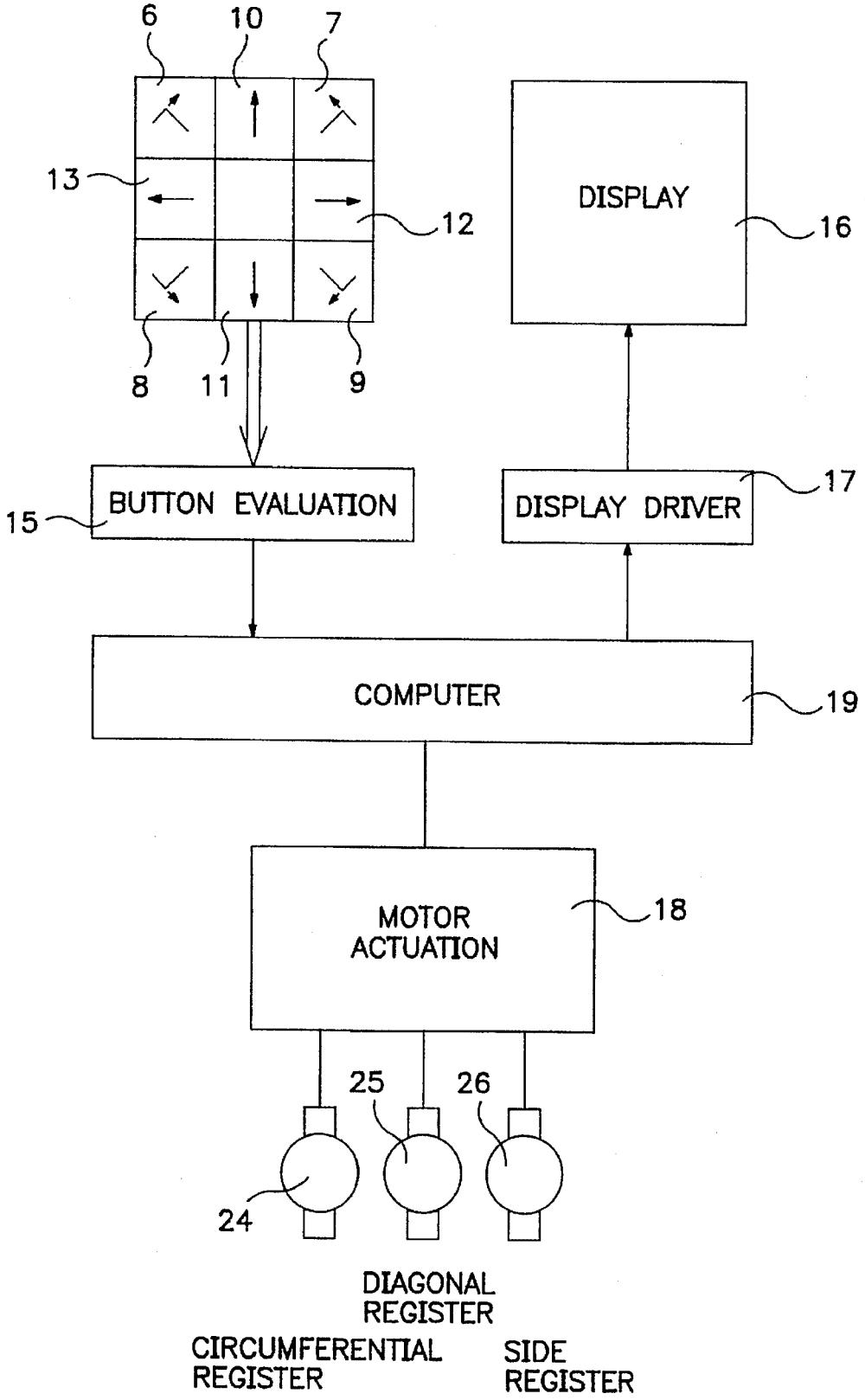
FIG. 4 shows a schematic illustration of a control system in which the control keys of FIG. 3 can be incorporated.
Figure 4A:
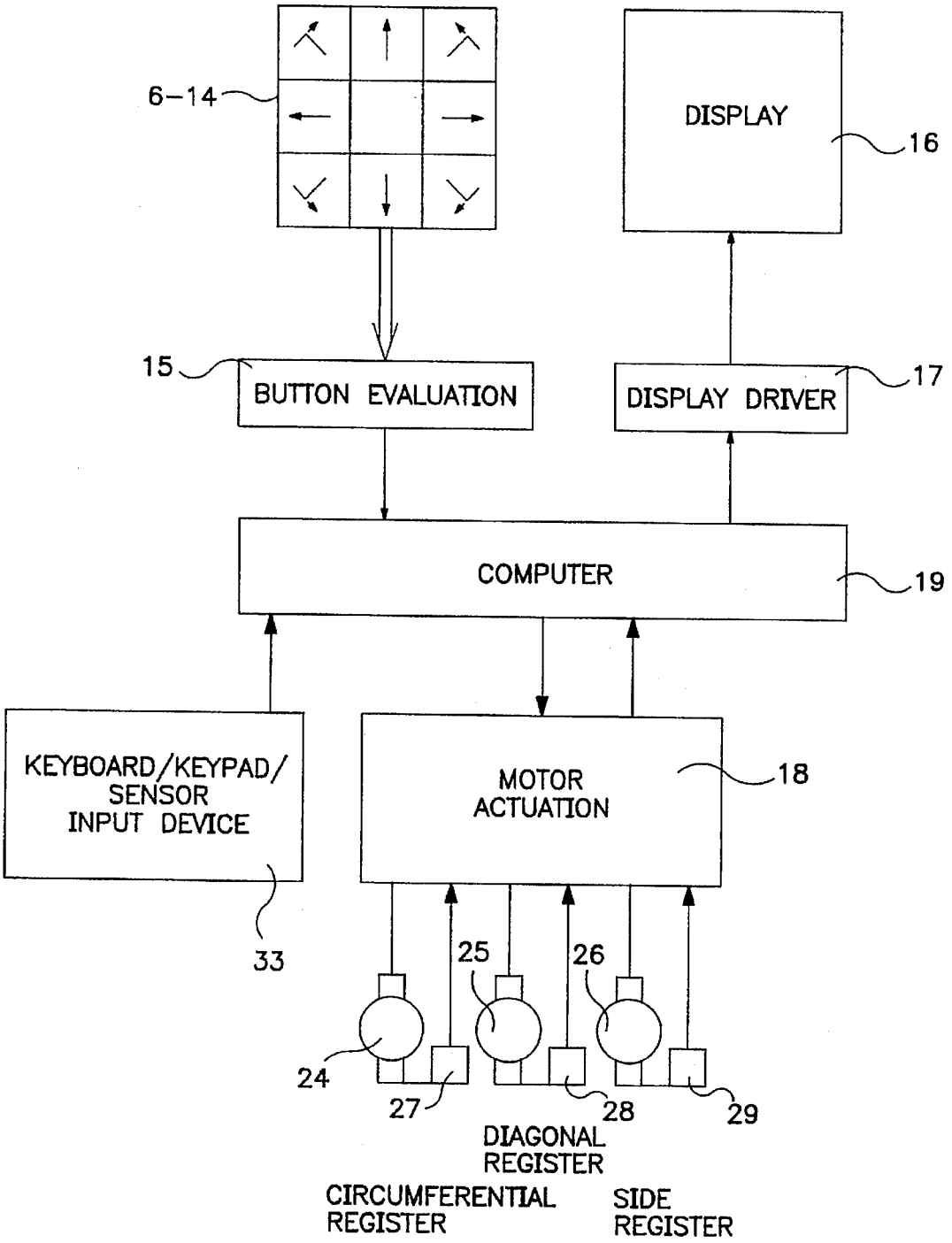
FIG. 4*a* shows a possible control panel embodiment with apparatus for inputting position data.

An apparatus for measuring and inputting such values is discussed briefly herebelow with reference to FIG. 4*a*.

In general, with the register error depicted in FIG. 2*a*, it is desireable to change the angle at which the plate cylinder is disposed in the press to change the diagonal register. However, in changing the diagonal register, the circumferential register will also be affected. Thus, under this pretext, if one was to pivot the cylinder to change the diagonal register, one would also affect the circumferential register of the point which was already in the desired position. However, if the cylinder was pivoted by an amount to which the circumferential deviation of both points 3 and 4 with respect to the desired locations 3' and 4' was the same, and then did a circumferential correction, the points could be brought in to proper alignment.

To further illustrate this principle, if, according to FIG. 1*e*, the press operator has measured a deviation (a) between the register mark 3 and the location 3' on the drive side, he or she can then also input the value (a) measured into the control unit so that the control unit can then calculate the negative adjustment travel (b) of the center of rotation 2 on the operating side, and adjust the eccentric bushing of the cylinder bearing to preferably provide the plate cylinder with the new center of rotation 2'. One possible mode of calculation for determining the travel (b) is set forth herebelow. At the same time, a circumferential-register correction can preferably be calculated and effected in the positive sense by the quantity (c) so that the point 4' can coincide with, or be brought back to, the position that the register mark 4 had previously been located. In this case, the inclination 5 between center of rotation 1 and center of rotation 2' can essentially be understood as moving upwards so that the register mark 3 can be brought into the position 3', or the corrected position.

In other words, since a pivoting of the center of rotation 2 towards the position 2' would essentially move both of the marks 3 and 4 to new positions 3" and 4" respectively, the center of rotation 2 can be lowered until a position 2' is reached at which the value c is equal to the value a'. Then, a circumferential register adjustment can be made to move both of the marks 3" and 4" back to the desired locations 3' and 4'.

Thus, in one embodiment of the invention, the overall position of the mark 4 can essentially be understood as remaining unchanged, while the mark 3 is raised to its new position at 3', thereby correcting for any positive deviation.

For this purpose, in accordance with the present invention, a control panel, such as the panel depicted by FIG. 3 can preferably be provided on the printing press, so that the press operator essentially only has to input the values (lateral locations of points 3 and 4, and deviation between 3 and 3'), and then press the control key 6 of the control panel. Alternatively, the control key 6 could be pressed first, and the computer could then be programmed to prompt the operator for the necessary values for carrying out the register adjustments.

Once the appropriate values have been entered into the computer processing system 19 (FIG. 4), the processing system can be programmed with the necessary calculation algorithms to determine the adjustment value (b). In at least one possible embodiment of the invention, the calculations can essentially be at least approximated by basing the calculations on the trigonometric function relating to the tangent of an angle of a right triangle, wherein the tangent of an angle is equal to the length of the side disposed opposite the angle, divided by the length of the side adjoining the angle or $$\text{tangent (alpha)} = \frac{\text{length of opposite side}}{\text{length of adjacent side}}$$

Using this formula in relation to FIG. 2*a*, it can be seen that $$\tan(\text{alpha}) = \frac{c}{d_{1-4}} \text{ and } \tan(\text{alpha}) = \frac{a'-a}{d_{1-3}}$$

Further, the center of rotation 2 is moved until c=a', and therefore the following relationship results:

$$\frac{a'}{d_{1-4}} = \frac{a'-a}{d_{1-3}}$$

As set forth above, the values a, $d_{1-4}$, and d are known, and therefor solving for a' gives:

$$a' = \frac{a}{1-\frac{d_{1-3}}{d_{1-4}}} = c$$

Thus, the angle (alpha) through which the cylinder has to be pivoted can then be calculated as follows:

$$\text{alpha} = \tan^{-1}\frac{c}{d_{1-4}}$$

Similarly, since the angle (alpha) has now been determined, the distance (b) can then also be calculated as follows:

$$b = \tan(\text{alpha}) \cdot d_{1-2}$$

The scheme in FIG. 2*b*, and outlined in the flow chart of FIG. 1*f*, showing a negative diagonal deviation on the drive side is essentially the opposite of the depiction of FIG. 2*a*, and can therefore essentially be explained in the same manner using the same reference numbers, and the same equations as set forth above, wherein in the equations set forth above, the distance b would be in an opposite direction. As such, after pressing the control key 8 of the control pad (see FIG. 3), the location values of marks 3 and 4 can be entered, followed by the deviation value (a). The control unit can then calculate a positive adjustment travel (b) of the center of rotation 2 on the operating side, and adjust the eccentric bushing of the cylinder bearing to give the plate cylinder the new center of rotation 2'. At the same time, a circumferential-register correction can preferably be calculated and effected in the negative sense by the quantity (c) so that the point 4" can coincide with, or be brought back to the position that the register mark 4 had previously been located. In this case, the inclination 5 between center of rotation 1 and center of rotation 2' can essentially be understood as moving downwards so that the register mark 3 can be brought into the position 3', or the corrected position. Thus, the overall position of the mark 4 essentially remains unchanged, while the mark 3 is lowered to its new position at 3', thereby correcting for any negative deviation.

Figure 2C:
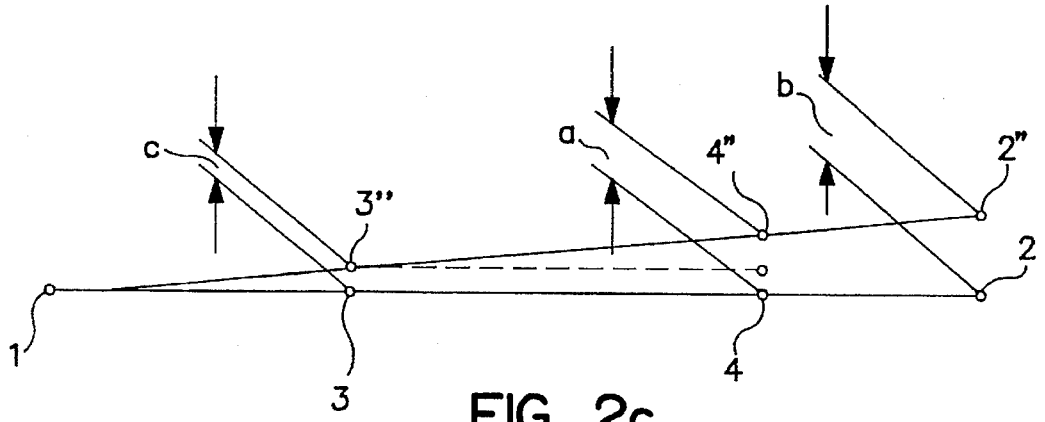
FIG. 2*c* shows a positive diagonal register deviation on the operating side.

FIG. 2*c* shows a positive register deviation, however on the operating side of the register mark 4. Here, too, the press operator can preferably select the register correction, that is, press button 7 (see FIG. 3), and input the lateral positions of the register marks 3 and 4. Then, the press operator can measure the deviation (a) of the register mark 4" and input the measured deviation value into the control unit. The control unit can then be programmed to compute the adjustment travel (b) on the operating side and preferably adjust the eccentric bushing to the position 2".

At the same time, the circumferential-register correction (c) can preferably be computed and effected by means of the circumferential-register control so that point 3" is brought back to coincide with the register mark, or the original position as indicated by 3. As indicated above, this adjustment depicted in FIG. 2*c* can preferably be effected by actuating the control key 7 (see FIG. 3), either before, or after entry of the measured values for 3 and 4.

Figure 6A:
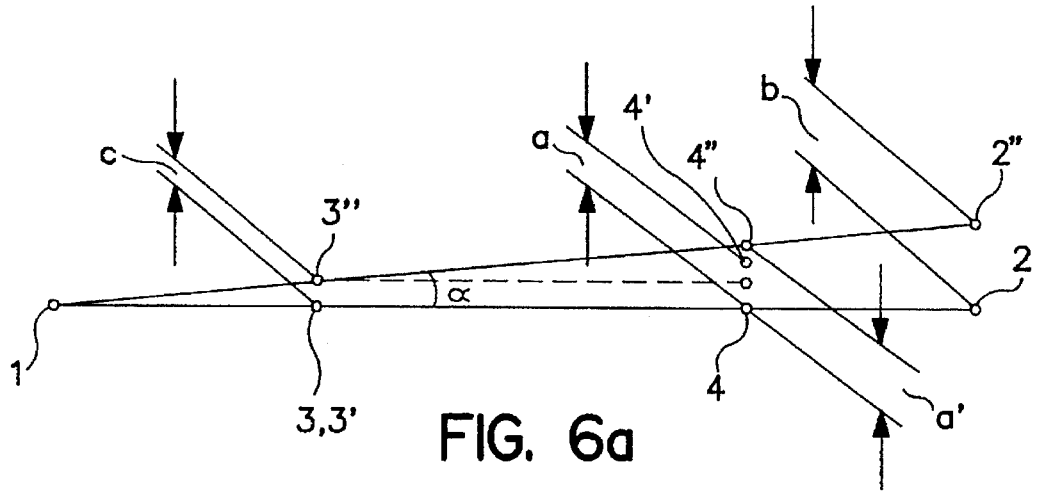
FIGS. 6*a* and 6*b* show alternative register corrections for an operating side deviation.

To better explain a positive operator side deviation, reference is now made to FIG. 6*a*. The flow chart of FIG. 1*g* corresponds with the representation shown in FIG. 6*a*.

In this representation, the location of the marks 3 and 4 are entered. In this case, the mark 3 is essentially disposed at the desired position 3', while the mark 4 is disposed below the desired location of 4' Thus, the location of the marks 3 and 4 (corresponding to distances $d_{1-3}$ and $d_{1-4}$ respectively), and the deviation of mark 4 from the position 4', where mark 4 should be located, can be determined and entered. The computer can then calculate the distance (b) by which the center of rotation 2 must essentially be moved in order to provide a corrected diagonal register at 2'. One example of a set of calculations which the computer could use is set forth herebelow. Since both marks 3 and 4 would move simultaneously during moving the center of rotation to the new position 2', the location of the marks 3 and 4 would be moved to the locations indicated as 3" and 4", both of which are slightly above the desired locations of 3' and 4' Thus, it could essentially be stated that the cylinder should be moved until the distance (a'—a) equals the distance (c).

Then, to bring the marks 3" and 4" back to the desired locations 3' and 4', the computer would also preferably calculate a corresponding shift in the circumferential register, or the negative movement (c). Thus, by performing both a diagonal register adjustment and a circumferential register adjustment, the location of the marks 3 and 4 could be moved to the desired locations of 3' and 4'.

In a similar manner as set forth above with reference to FIG. 2*a*, once the appropriate values have been entered into the computer processing system 19 (FIG. 4), the processing system can be programmed with the necessary calculation algorithms to determine the adjustment value (b), again based on the trigonometric function relating to the tangent of an angle of a right triangle:

$$\text{tangent (alpha)} = \frac{\text{length of opposite side}}{\text{length of adjacent side}}$$

Using this formula in relation to FIG. 6*a*, it can be seen that $$\tan(\text{alpha}) = \frac{c}{d_{1-3}} \text{ and } \tan(\text{alpha}) = \frac{a'}{d_{1-4}}$$

Further, the center of rotation 2 is moved until a'=c+a, and therefore the following relationship results:

$$-\frac{c}{d_{1-3}} = \frac{c+a}{d_{1-4}}$$

As set forth above, the values a, $d_{1-4}$, and d are known, and therefor solving for c gives:

$$c = \frac{a}{\frac{d_{1-4}}{d_{1-3}} - 1}$$

Thus, the angle (alpha) through which the cylinder has to be pivoted can then be calculated as follows:

$$\text{alpha} = \tan^{-1}\frac{c}{d_{1-3}}$$

Similarly, since the angle (alpha) has now been determined, the distance (b) can then also be calculated as follows:

$$b = \tan(\text{alpha}) \cdot d_{1-2}$$

Figure 2D:
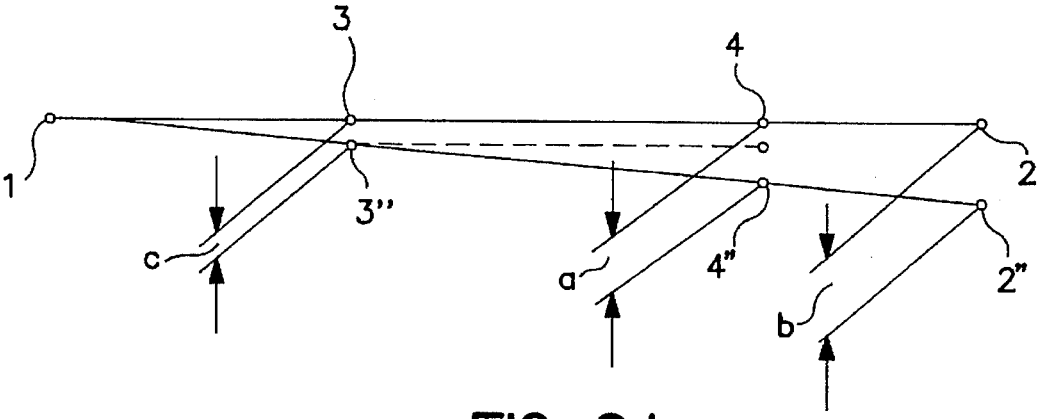
FIG. 2*d* shows a negative diagonal register deviation on the operating side.

Similarly, as was the case for the drive side deviations, the scheme in FIG. 2*d*, shows a negative diagonal deviation on the operating side, which is essentially the opposite of the depiction of FIG. 2*c*, and can therefore essentially be explained in the same manner as 2*c* using the same reference numbers. As such, the press operator can preferably select the register correction, that is, press button 9 (see FIG. 3), and input the lateral positions of the register marks 3 and 4. Then he or she can measure the deviation a of the register mark 4", and input the measured deviation value into the control unit. The control unit can then be programmed to compute the adjustment travel b on the operating side and adjust the eccentric bushing to the position 2".

At the same time, the circumferential-register correction c can preferably be computed and effected by means of the circumferential-register control so that point 3" is brought back to coincide with the register mark, or the original position as indicated by 3.

Figure 6B:
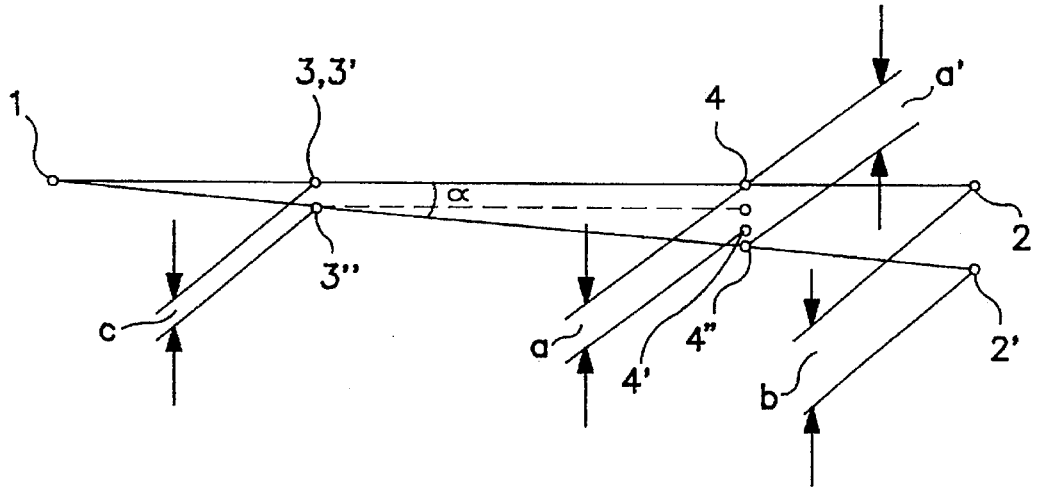

To better explain the negative operator side deviation, reference is now made to FIG. 6*b*. The flow chart of FIG. 1*h* corresponds with the representation shown in FIG. 6*b*, and the calculations as set forth above with respect to FIG. 6*a* would also apply, wherein the distance b would however be in an opposite direction.

In this representation of FIG. 6*b*, the location of the marks 3 and 4 are entered. In this case, the mark 3 is essentially disposed at the desired position 3', while the mark 4 is disposed above the desired location of 4'. Thus, the location of the marks 3 and 4 (corresponding to distances $d_{1-3}$ and $d_{1-4}$ respectively), and the deviation of mark 4 from the position 4', where mark 4 should be located, can be determined and entered. The computer can then calculate the distance (b) by which the center of rotation 2 must essentially be moved in order to provide a corrected diagonal register at 2', for example by using the above-derived equations. Since both marks 3 and 4 would move simultaneously during moving the center of rotation to the new position 2', the location of the marks 3 and 4 would be moved to the locations indicated as 3" and 4', both of which are slightly below the desired locations of 3' and 4'. Thus, it could essentially be stated that the cylinder should be moved until the distance (a'—a) equals the distance (c).

Then, to bring the marks 3" and 4" back to the desired locations 3' and 4', the computer would also preferably calculate a corresponding shift in the circumferential register, or the positive movement (c). Thus, by performing both a diagonal register adjustment and a circumferential register adjustment, the location of the marks 3 and 4 could be moved to the desired locations of 3' and 4'.

The apparatus for conducting the above-described register corrections will now be set forth in greater detail herebelow.

FIG. 3 is a block diagram schematically representing the control keys as mentioned above. In such a key control, control keys 6 through 9 can be configured to serve the purpose of correcting the diagonal register in the manner as discussed above. The control keys 6 and 7 could thus be configured for being actuated in the case of an upward register deviation, i.e. a register deviation in the positive range, whereas the control keys 8 and 9 could be configured for being actuated in the case of a downward register deviation, i.e. a register deviation in the negative range.

Additionally, the control keys could also preferably be configured with control keys 10 and 11, which could respectively, preferably serve to effect either a positive or negative correction of essentially only the circumferential register. Similarly, control keys 12 and 13 could also be provided to respectively provide positive and negative correction of the lateral register. In the center 14 of the key field, there may preferably be provided a control lamp indicating to the press operator that the control device, with which corrections of the diagonal register, etc. are effected, is switched on.

Thus, in accordance with the present invention, a control device can preferably be provided having control keys 6 and 8 for diagonal-register corrections on the drive side, and control keys 7 and 9 for diagonal-register corrections on the operating side.

FIG. 4 shows one embodiment of an arrangement which could incorporate the control keys 6–13. In essence, such an arrangement could be provided as an accessory to, or a standard component of a printing press, or of an operators control panel of a printing press. As depicted in FIG. 4, the control keys 6–13 could be electrically connected to a device 15 for evaluating which of the keys 6–13 has been depressed, or activated. This evaluation device can essentially be a known device commonly used for evaluation of a keyboard, or keypad to determine which button has been depressed, and then sending a signal, i.e., and electrical signal, corresponding to the depressed button to the microprocessor for selection of an appropriate program sequence.

Thus, by connecting the keys 6–13, via an evaluation device 15, to the microprocessor through an input port of the microprocessor, an appropriate electronic signal could then be sent from the device 15 to the computer, or processing unit 19 to enable the appropriate calculation algorithms for the selected key.

The computer 19 could then prompt the operator, via a display device 16 that is preferably operated via a display driver 17, for entry of values corresponding to the location of marks 3 and 4, and the measured value for the deviation of a mark from the ideal position. Such a display device could be a full computer monitor, a display screen having only a few display lines, or even an output printer. Each of these display devices could be connected via an appropriate display drive, to an output port of the computer 19. Such display devices, and display drivers are generally well in the computer field and are therefor not explained in any greater detail herein.

Figure 1I:
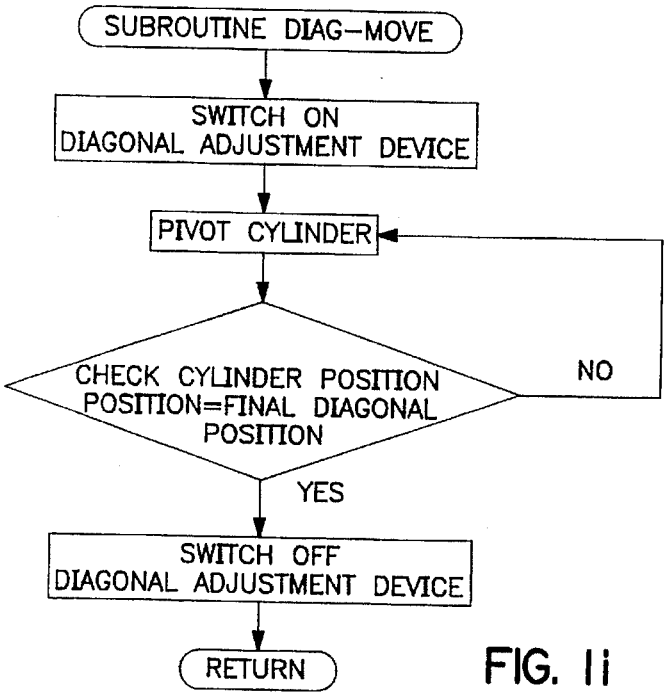
FIGS. 1*i*–1*j* show additional flow charts of subroutines.
Figure 1J:
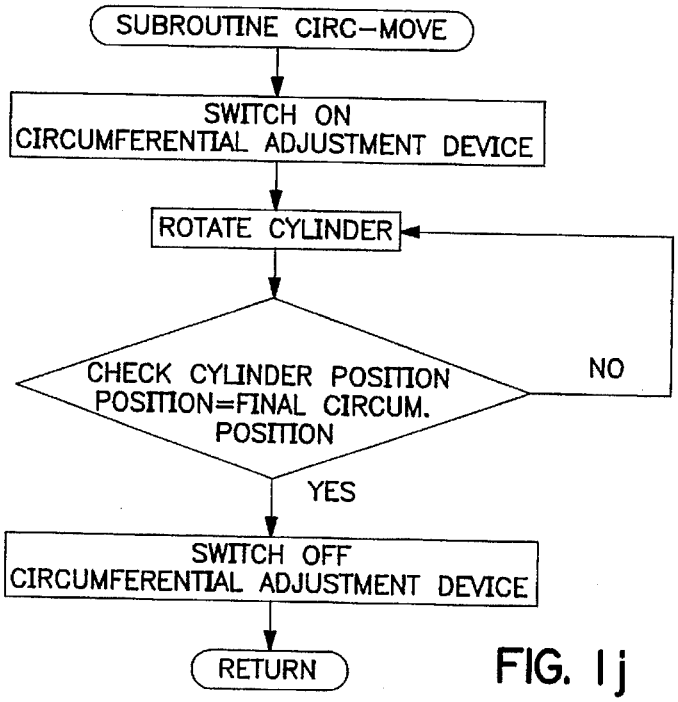

Once the necessary values are entered, in a manner as will be discussed in more detail hereinbelow, the computer can then preferably calculate, based upon the selected deviation as chosen by depressing an appropriate button 6—13, the types of register movements that are needed to correct for the register of the printing plate, via the calculation algorithms as set forth above. Alternatively, the computer could be provided with a table of correction values specific to the printing plates used thereon. Such table, alternatively called look-up tables, could cross-reference each deviation (a) with a distance (b) for a given printing plate, and the computer receiving the value (a) could then simply reference the appropriate table relating to the lateral positions of the points 3 and 4. After determining the value of (b) an appropriate electronic signal can be sent to an actuating device 18, to actuate positioning motors 24, 25 and 26 to provide the necessary movements of the circumferential, diagonal and/or side registers, respectively. An additional depiction of such a control arrangement is shown in FIG. 4*a*, wherein the positioning motors, which could preferably be servomotors, are provided with respective adjustment sensors 27, 28 and 29 for providing position feedback with respect to the position of the cylinder, in terms of its lateral, circumferential, or diagonal position. The general operation of such a feedback control loop is provided by the flow chart depicted in FIGS. 1*i* and 1*j*. Such servo-motors and feedback sensors are generally known as disclosed by U.S. Pat. No. 5,117,365 to Jeschke and Rodi, and are therefore not described in any greater detail herein.

FIG. 4*a* also depicts several alternative arrangements which could be used for inputting the location values of the marks 3 and 4, and the deviation values for any offset. One type of input unit 33, could possibly be a sensor surface corresponding to the printed image, and formed as an array of light-sensitive elements, which can be activated by a light pen, as also disclosed by the above referenced U.S. Pat. No. 5,117,365. Alternatively, U.S. Pat. No. 5,117,365 also discloses, instead of the light-sensitive elements and light pen, a surface provided with pressure sensitive sensors which could be activated by finger pressure, etc. Alternatively, other types of sensors, or even keys or pushbuttons, could also be used, and depending on the particular application, it would typically be well within the skill of the artisan to choose the most favorable, or suitable, sensor arrangement.

An additional embodiment for entering the register mark values could be provided by a control console such as a control console CPC 1, manufactured by the firm HEIDELBERGER DRUCKMASCHINEN AKTIENGESELLSHAFT (source Heidelberger News 3/40).

A still further input device is provided by the CPC 4 unit also manufactured by the firm HEIDELBERGER DRUCKMASCHINEN AKTIENGESELLSHAFT (as described in brochures DRUPA 90, publication HN 1/48 e, published by HEIDELBERGER DRUCKMASCHINEN AG, and 50 YEARS OF HEIDELBERG NEWS, publication HN 3/50 e, copyright 1993 HEIDELBERGER DRUCKMASCHINEN AG). The CPC 4 unit is preferably designed to read coordinate data by means of its positioning on a surface, and transmit the data to the CPC 1.

The control station CPC 1, which can be used for controlling the above described arrangements as well as the control keypad of the present invention, is further described in U.S. Pat. No. 4,998,472 to Rodi et al. and also assigned to HEIDELBERGER DRUCKMASCHINEN AG.

Additional input devices and calculation techniques are disclosed by U.S. Pat. No. 4,827,626 to Wieland.

Alternately, a simple numeric keypad could be provided for entering coordinate data of the register marks manually into the computer.

Figure 5:
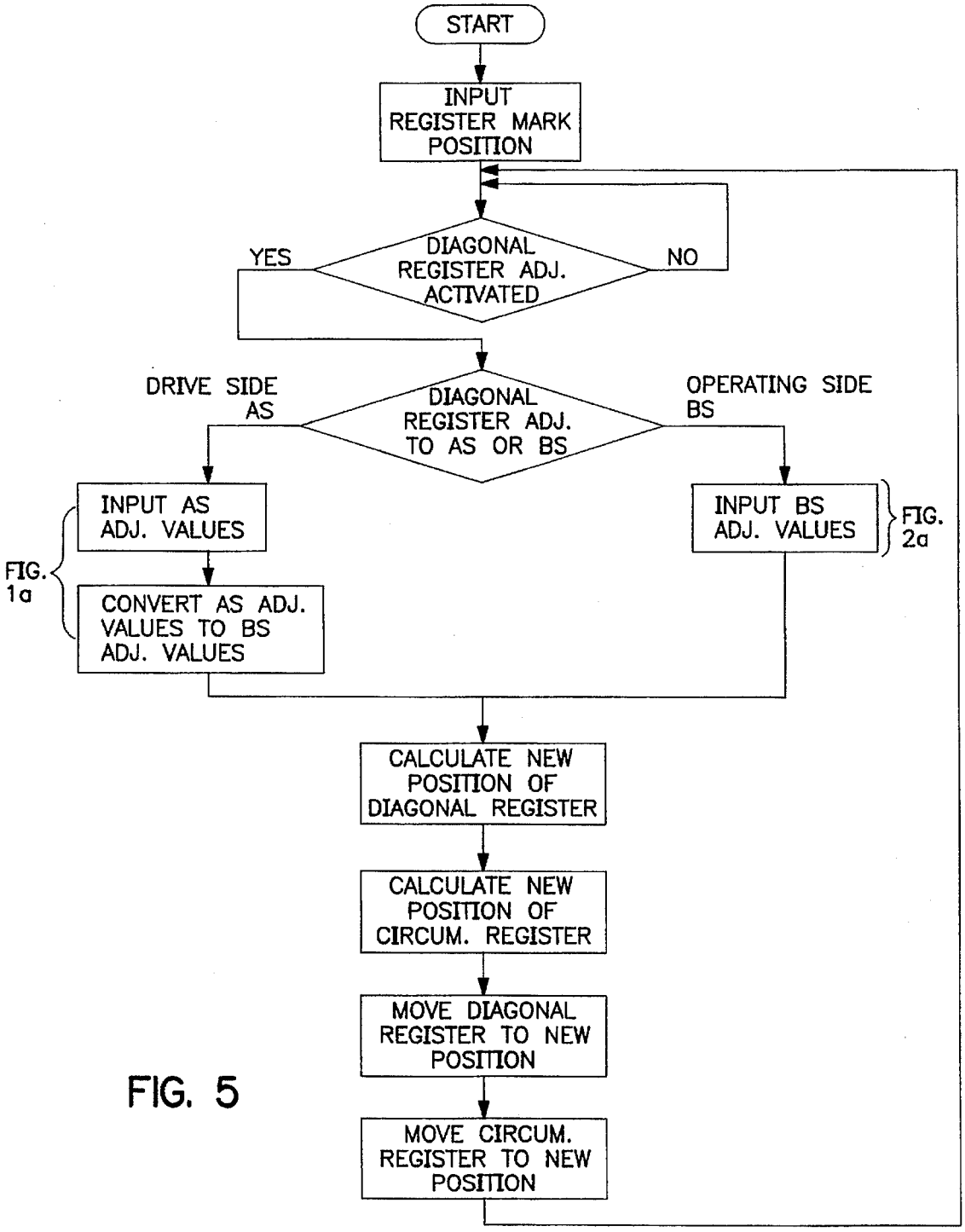
FIG. 5 provides a flow chart of steps for a process of register correction in accordance with the present invention.

As outlined in FIG. 5, a variation on the sequence of operator steps in accordance with one possible embodiment of the present invention is provided in a simplified manner. In the depicted process steps, the positions of the marks 3 and 4 can preferably be entered into the computer 19 (see FIG. 4) in a first step via one of the input devices discussed above. Next, a determination can be made as to whether a diagonal adjustment needs to be performed, if yes, one of the appropriate keys 6–9 can be depressed indicating the type of adjustment to be made. The adjustment value (a) can then preferably be entered, similarly by the input device. If the adjustment is on the drive side of the press, since the plate cylinder is essentially fixed on the drive side, the adjustment values can preferably be converted into operating side values for determining the adjustment needed on the operating side to compensate for the adjustment needed on the drive side. Then, the computer 19 can preferably calculate the new diagonal position needed and the corresponding circumferential change needed, and can move the diagonal register to a new position via servomotor 25, and can move the circumferential register to a new position via servomotor 24.

At this juncture, a new printed image could preferably be produced and the marks rechecked, and if necessary, the above-outlined process could be repeated.

FIG. 7 shows one type of printing stand for a printing press, which could utilize the control keys in accordance with the present invention. In essence, the view shown could be considered as the operating side of the press, or the side opposite to the drive side, wherein a view of the drive side would essentially be the same, but a reverse image thereof, with the possible exception of the mountings, such as the eccentric bearing, shown schematically.

In essence, the components depicted in FIG. 7, are generally well known in the art, and are therefore only summarized briefly herebelow. While the embodiment depicted by FIG. 7 shows one type of printing press, the apparatus in accordance with the present invention can be applied to other types of presses as well. While not shown, such a printing stand will have side walls to which the various depicted components can be mounted. In the depicted embodiment, the typical parts of a printing stand 10' can generally include: a plate cylinder 11' having mounted thereon a printing plate P; an inking unit 12' which includes ink applicator rollers 13' for applying, to printing plate P, an ink profile of a single color printing ink (for example, black, cyan, magenta or yellow, etc.); a dampening (or wetting) unit 18' having dampening applicator rollers 19' for transferring a dampening agent to printing plate P; a blanket cylinder 16' carrying a rubber blanket 17' for receiving an ink impression from printing plate P; and a sheet drum 15' for carrying a printed sheet 14' onto which the ink impression carried by blanket 17' can be transferred.

It is particularly important that the ink be applied to printing plate P in a precisely defined and controllable manner. To this end, the printing unit 10' may be provided with an ink duct 21', which duct 21' can preferably extend across the width of the inking unit 10'. The zonal adjustment of the ink application profile can be provided by a plurality of ink metering ducts 22', which can preferably be disposed along the length of the ink duct 21', which ducts 22' may be controlled or adjusted by a zonal ink metering adjustment mechanism 30' under the control of a computer 31'.

A duct roller 23' can typically be mounted adjacent to ink duct 21' Typically, the ink application profile which is preferably set up on duct roller 23' can be transferred into the inking unit 12' by means of a vibrator roller 24', which roller 24' can oscillate to successively pick up strips of ink from duct roller 23' and preferably transfer the strips of ink into inking unit 12', as for example, by preferably contacting one of the rollers 32' of the inking unit 12'.

Typically, the printing stand 10' can also include auxiliary mechanisms such as, for example, a duct roller drive 28', a vibrator roller drive 29', an applicator roller throw-off 27' for lifting the ink applicator rollers 13' off of the printing plate P, a press drive 25' and a sheet feed 27' for supplying the sheets to be printed 26' to sheet drive drum 15'.

In addition, the printing press can be provided with at least one washing apparatus for washing the rollers of the press. As shown in the example of FIG. 7, such a washing apparatus 38' could preferably be configured to cooperate with the blanket cylinder 16', yet it should be understood that other possible placements can be provided within the printing unit. Washing apparatus 38' can preferably be adapted to be brought into contact with the outer cylindrical surface, i.e. with the rubber blanket 17', of rubber blanket cylinder 16', by the operation of a control device, shown schematically, which, in essence could be controlled by the control computer 31'. Washing apparatus 38' can include two washing rollers 39' as well as common roller 40' that preferably connects the two washing rollers 39' together. There could also preferably be a transfer roller 41', which can preferably be in contact with common roller 40' and to which washing liquid 43' can be supplied by either spray apparatus 42', or another similar device. A doctor blade apparatus 44' could be positioned to cooperate with roller 40' to scrape residue from roller 40', and collection trough 45' could be positioned under roller 40' for collecting excess washing liquid and ink residue therein.

The control computer 31 depicted in FIG. 7 could, in one embodiment of the present invention, be the computer 19 depicted in FIGS. 4 and 4*a*. while the data input device 32' could comprise one of the input devices depicted in FIGS. 4 and 4*a*. In essence, the control computer 31' shown in FIG. 7 could comprise one of the embodiments shown in FIGS. 4 and 4*a*, including the key controls 6—13.

One feature of the invention resides broadly in the device designed to correct the diagonal register on a printing machine, comprising a control console including operating elements to input commands, display elements to display a respective status, and control keys to input the diagonal-register deviation in the area of the register marks on the printed sheet, with the plate cylinder to be corrected being firmly supported on the drive side and being pivot-mounted on the operating side, characterized in, that two control keys 7,9 for respectively positive and negative correction of the diagonal register are provided for the operating side of the plate cylinder to effect a control action, with the cylinder bearing on the operating side being adjusted by a value b calculated on the basis of the measured deviation a of the register mark 4 on the operating side, and with the circumferential register being corrected accordingly c, and that two further control keys 6,8 for respectively positive and negative correction of the diagonal register are provided for the drive side of the plate cylinder to effect a control action, with the circumferential register of the plate cylinder and the cylinder bearing on the operating side being adjusted by a value b,c calculated on the basis of the deviation a of the register mark 3 measured on the drive side.

While the computer processor components, display components and register correction motors and controls as discussed hereinabove are generally known in the field of computer processing technology, and therefore not discussed in any greater detail herein, some additional examples of accessories and electrical components which could be used in the context of the present invention are disclosed by the following U.S. Pat. No. 5,056,430 to Bayerlein and Leuerer, entitled "Method of Positioning Plate Cylinders in a Multi-Color Rotary Printing Machine"; U.S. Pat. No. 4,980,718 to Salter et al., entitled "Registration Method in Photolithography and Equipment for Carrying Out This Method"; U.S. Pat. No. 4,956,662 to Sakai et al., entitled "Apparatus for and Method of Recording Color Picture Image"; U.S. Pat. No. 4,553,478 to Greiner, entitled "Printing Machine Pre-Setting Arrangement"; and U.S. Pat. No. 4,694,749 to Takeuchi, entitled "Method of Presetting Plate Cylinders for Registering in an Offset Printing Press". A further depiction of computer and electrical circuitry which could possibly be used in conjunction with the present invention is disclosed by International Patent No. WO 83/04219 to Gneuchtel et al.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 43 14 228.1, filed on Apr. 30, 1993, having inventors Reinhard Broghammer and Gregor Flade, and DE-OS P 43 14 228.1 and DE-PS P 43 14 228.1, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A device for correcting the diagonal register of a plate cylinder of a printing machine, the plate cylinder having a first side and a second side, the first side of the plate cylinder being mounted in a substantially fixed position within the printing machine, the second side of the plate cylinder being pivotally mounted within the printing machine, the circumferential direction about the plate cylinder defining a direction of diagonal registration deviation, a positive diagonal registration deviation being opposite in direction from a negative diagonal registration deviation, said device comprising:

a plurality of control buttons;

an apparatus for effecting a control action in response to said control buttons;

said apparatus for effecting a control action in response to said control buttons comprising apparatus for:

adjusting the circumferential register of the plate cylinder; and pivotally displacing the second side of the plate cylinder;

a control console;

said apparatus for effecting a control action in response to said control buttons being operatively connected to said control console; and said control console comprising:

at least one operating element for inputting operating commands;

at least one display element for displaying operating data of the printing machine;

said plurality of control buttons;

said plurality of control buttons for inputting register deviations of the plate cylinder; and said plurality of control buttons comprising:

a first control button for providing a positive correction of the diagonal registration of the second side of the plate cylinder;

a second control button for providing a negative correction of the diagonal registration of the second side of the plate cylinder;

a third control button for providing a positive correction of the diagonal registration of the first side of the plate cylinder; and a fourth control button for providing a negative correction of the diagonal registration of the first side of the plate cylinder.

2. The device according to claim 1, wherein:

said apparatus for effecting a control action in response to said control buttons further comprises apparatus for calculating a control action in response to an input register deviation of the plate cylinder; and said apparatus for calculating a control action is configured for:

calculating a pivotal displacement of the second side of the plate cylinder; and calculating an adjustment of the circumferential register of the plate cylinder.

3. The device according to claim 2, wherein said apparatus for calculating a control action further is configured for:

calculating a pivotal displacement of the second side of the plate cylinder to correct an input register deviation corresponding to a correction of the diagonal registration of the first side of the plate cylinder; and calculating a pivotal displacement of the second side of the plate cylinder to correct an input register deviation corresponding to a correction of the diagonal registration of the second side of the plate cylinder.

4. The device according to claim 3, wherein said plurality of control buttons further comprises:

a fifth control button for providing a positive correction of the circumferential registration of the printing machine;

a sixth control button for providing a negative correction of the circumferential registration of the printing machine; and the negative correction of the circumferential registration of the printing machine is substantially opposite the positive correction of the circumferential registration of the printing machine.

5. The device according to claim 4, wherein:

said apparatus for effecting a control response in response to said control buttons further comprises apparatus for adjusting the lateral register of the plate cylinder; and said plurality of control buttons further comprises:

a seventh control button for providing a positive correction of the lateral registration of the plate cylinder;

an eighth control button for providing a negative correction of the lateral registration of the plate cylinder; and the negative correction of the lateral registration of the plate cylinder is substantially opposite the positive correction of the lateral registration of the plate cylinder.

6. The device according to claim 5, wherein: said eight control buttons are disposed in said control console; and said eight control buttons are also disposed generally in the shape of a square, the square having four corners thereof, with one of said control buttons disposed in each of the four corners, and one of said control buttons disposed between each pair of adjoining corners, and said control buttons forming an upper row, a middle row below the upper row, and a bottom row below the middle row, and a left column, a middle column to the right of the left column and a right column to the right of the middle column, wherein:

the upper left control button is said first control button;

the upper middle control button is said fifth control button;

the upper right control button is said third control button;

the middle left control button is said seventh control button;

the middle right control button is said eighth control button;

the lower left control button is said second control button;

the lower middle control button is said sixth control button; and the lower right control button is said fourth control button.

7. The device according to claim 6, comprising:

a monitoring apparatus for monitoring movement of said apparatus for effecting a control action;

a display device for displaying instructions for inputting data and visually depicting inputted values;

said at least one operating element further comprises at least one of:

a keyboard for typing data;

a keypad for typing data; and sensor apparatus for sensing a registration deviation of the plate cylinder.

8. A device for adjusting the diagonal registration of a plate cylinder of a printing press, the plate cylinder having a first side and a second side, said device comprising:

apparatus for mounting the first side of the plate cylinder in a substantially fixed position within the printing press and for pivotally mounting the second side of the plate cylinder within the printing press;

a displacement device for displacing the plate cylinder;

said displacement device comprising apparatus for:

pivoting the second side of the plate cylinder with respect to the first side of the plate cylinder; and rotating the plate cylinder about the axis of rotation to adjust a circumferential alignment of the printing plate;

a computer processor unit for generating adjustment signals for adjusting the alignment of the printing plate;

said computer processor unit being operatively connected to said displacement device;

a data input unit for receiving data and inputting the data into the computer processor unit;

said computer processor unit comprising at least one calculation algorithm for correcting the diagonal registration of the printing plate;

said at least one calculation algorithm comprising:

a first calculation for calculating a pivotal movement of the plate cylinder to provide a first positive correction of the diagonal registration of the second side of the plate cylinder;

a second calculation for calculating a pivotal movement of the plate cylinder to provide a first negative correction of the diagonal registration of the second side of the plate cylinder;

a third calculation for calculating a pivotal movement of the plate cylinder to provide a second positive correction of the diagonal registration of the first side of the plate cylinder; and a fourth calculation for calculating a pivotal movement of the plate cylinder to provide a second negative correction of the diagonal registration of the first side of the plate cylinder;

each positive correction of the diagonal registration being substantially opposite its corresponding negative correction of the diagonal registration;

a control console for selecting one of the first, second, third and fourth calculations;

said computer processor unit being operatively connected to said control console; and said control console comprising:

a first pushbutton for selecting the first calculation;

a second pushbutton for selecting the second calculation;

a third pushbutton for selecting the third calculation; and a fourth pushbutton for selecting the fourth calculation.

9. The device according to claim 8, wherein:

said at least one calculation algorithm comprises a fifth calculation for calculating a rotational movement of the plate cylinder to provide a correction of the circumferential registration of the plate cylinder to compensate for a pivotal movement of the plate cylinder; and each of said first, second, third and fourth pushbuttons also selects the fifth calculation for calculating a rotational movement of the plate cylinder to compensate for the calculated pivotal movement corresponding to the selected pushbutton.

10. The device according to claim 9, wherein:

said at least one calculation algorithm comprises:

a sixth calculation for calculating a rotational movement of the plate cylinder to provide a positive correction of the circumferential registration of the plate cylinder;

a seventh calculation for calculating a rotational movement of the plate cylinder to provide a negative correction of the circumferential registration of the plate cylinder; and the positive correction of the circumferential registration is substantially opposite the negative correction of the circumferential registration; and said control console comprises:

a fifth pushbutton for selecting said sixth calculation; and a sixth pushbutton for selecting said seventh calculation.

11. The device according to claim 10, wherein: said displacement device comprises apparatus for laterally displacing the printing plate on the plate cylinder in the lateral direction of the cylinder, to adjust a lateral alignment of the printing plate.

12. The device according to claim 11, wherein:

said at least one calculation algorithm comprises:

an eighth calculation for calculating a lateral displacement of the printing plate on the plate cylinder to provide a positive correction of the lateral registration of the plate cylinder; and a ninth calculation for calculating a lateral displacement of the printing plate on the plate cylinder to provide a negative correction of the lateral registration of the plate cylinder;

the positive correction of the lateral registration is substantially opposite the negative correction of the lateral registration; and said control console comprises:

a seventh pushbutton for selecting said eighth calculation; and an eighth pushbutton for selecting said ninth calculation.

13. The device according to claim 12, wherein said eight pushbuttons are disposed generally in the shape of a square, the square having four corners thereof, with one of said pushbuttons disposed in each of the four corners, and one of said pushbuttons disposed between each pair of adjoining corners, and said pushbuttons forming an upper row, a middle row below the upper row, and a bottom row below the middle row, and a left column, a middle column to the right of the left column and a right column to the right of the middle column, wherein:

the upper left pushbutton is said first pushbutton;

the upper middle pushbutton is said fifth pushbutton;

the upper right pushbutton is said third pushbutton;

the middle left pushbutton is said seventh pushbutton;

the middle right pushbutton is said eighth pushbutton;

the lower left pushbutton is said second pushbutton;

the lower middle pushbutton is said sixth pushbutton; and the lower right pushbutton is said fourth pushbutton.

14. The device according to claim 13, wherein:

said electronic system further comprises:

a display apparatus for displaying instructions for inputting data and visually depicting inputted values; and monitoring apparatus for monitoring movement of the displacement device to indicate the degree of displacement achieved; and said data input unit comprises at least one of:

a keyboard for typing data;

a keypad for typing data; and sensor apparatus for sensing a register deviation of the plate cylinder.

15. An electronic system for adjusting the alignment of a printing plate disposed circumferentially about a plate cylinder of a printing press, the plate cylinder having a first side and a second side, and an axis of rotation extending through said first side and said second side, the plate cylinder defining a lateral direction along the axis of rotation, a circumferential direction rotationally about the axis of rotation, and a diagonal direction corresponding to movement of at least one of the first and second sides with respect to the other of the first and second sides, the plate cylinder having an axle defining the axis of rotation, the axle having a first end disposed adjacent the first side of the plate cylinder and a second end disposed adjacent the second side of the plate cylinder, said system comprising:

an apparatus for mounting the plate cylinder in the printing press;

said apparatus for mounting the plate cylinder in the printing press comprising:

a first axle mounting apparatus for mounting the first axle end in a substantially fixed position within the printing press; and a second axle mounting apparatus for mounting the second axle end in the printing press, said second axle mounting apparatus comprising apparatus for permitting pivoting of the second axle end with respect to the first axle end;

a displacement device for displacing the plate cylinder, said displacement device comprising:

an angular displacement device for angularly displacing the axis of rotation of the plate cylinder to move one of the first and second sides of the plate cylinder with respect to the other of the first and second sides to adjust a diagonal alignment of the printing plate;

said angular displacement device comprising a pivot apparatus for pivoting the second axle end with respect to the first axle end; and a circumferential displacement device for rotating the plate cylinder about the axis of rotation to adjust a circumferential alignment of the printing plate;

a computer processor unit for generating adjustment signals for adjusting the alignment of the printing plate;

a receiving device for receiving said respective adjustment signals from the computer processor unit and for operating said displacement device as a function of said adjustment signals to adjust both the diagonal register of the printing plate and the circumferential register of the printing plate;

a data input unit for receiving data and inputting the data into the computer processor unit, which data comprises data representative of:

a location of at least two reference points of the printing plate, said at least two points comprising at least a first point disposed towards the first side of the plate cylinder and at least a second point disposed towards the second side of the plate cylinder; and a deviation of at least one of said at least two points from a corresponding reference position for each of the at least two points, the deviation comprising one of the following items:

A) a deviation of said first point in a first direction away from its said corresponding reference position;

B) a deviation of said first point in a second direction away from its said corresponding reference position;

C) a deviation of said second point in a first direction away from its said corresponding reference position; and D) a deviation of said second point in a second direction away from its corresponding reference position;

the first and second directions of deviation of said first point comprising diagonal directions of the plate cylinder, the second direction of deviation of said first point being substantially opposite to the first direction of deviation of said first point;

the first and second directions of deviation of said second point comprising diagonal directions of the plate cylinder, the second direction of deviation of said second point being substantially opposite to the first direction of deviation of said second point; said computer processor unit further comprising:

a calculating unit for calculating from the input data, said respective adjustment signals for adjusting said displacement device;

said calculating unit comprising:

pre-programmed calculation algorithms corresponding to at least each of items: A), B), C) and D);

a first adjustment signal unit for calculating a first adjustment signal for moving the second axle end with respect to the first axle end to provide a correction in the diagonal register of the printing plate;

a second adjustment signal unit for calculating a second adjustment signal for circumferentially displacing the printing plate about the axis of rotation to provide a correction in the circumferential register of the printing plate; and a transmitting unit for transmitting the respective adjustment signals from said calculating unit to said receiving device and operating to operate said displacement device;

a control console for selecting a deviation Corresponding to one of items: A), B), C) and D) for directing the computer processor unit in determining respective adjustment signals for adjusting the plate cylinder;

said control console comprising a signal generator for producing an electronic signal corresponding to the selected one of items: A), B), C) and D);

a monitoring device for monitoring said control console for receiving said produced electronic signal, evaluating said produced electronic signal to determine the one of items: A), B), C) and D) selected, and controlling operation of said computer processor unit on the basis of the selected one of items: A), B), C) and D); and said control console further comprising:

a keypad for selecting one of items: A), B), C) and D) for directing the computer processor unit in determining respective adjustment signals for adjusting said displacement device; and said keypad comprising at least four push-buttons electrically connected to said monitoring device, each of said push-buttons being for directing the computer processor unit in selecting calculation algorithms for determining adjustment signals, wherein:

a first push-button corresponds to item A);

a second push-button corresponds to item B);

a third push-button corresponds to item C); and a fourth push-button corresponds to item D).

16. The electronic system according to claim 15, wherein:

said data input unit is further configured for receiving data representative of:

a distance value corresponding to the deviation of said at least two points in solely a substantially circumferential direction, the deviation in solely a substantially circumferential direction comprising one of:

E) a circumferential deviation in a first circumferential direction of said at least two points; and F) a circumferential deviation in a second circumferential direction of said at least two points, the second circumferential direction being substantially opposite to the first circumferential direction;

said pre-programmed calculation algorithms further comprise algorithms corresponding to items: E) and F);

said control console is further configured for selecting a deviation corresponding to one of items: E) and F) for directing the computer processor unit in determining respective adjustment signals for adjusting the plate cylinder;

said signal generator is further configured to produce an electronic signal corresponding to the selected one of items: E) and F);

said monitoring device is further configured for evaluating said produced electronic signal to determine the one of items E) and F) selected, and controlling operation of said computer processor unit on the basis of the selected one of items: E) and F);

said keypad is further configured for selecting one of the items: E) and F) for directing the computer processor unit in determining respective adjustment signals for adjusting said displacement device;

said at least four push-buttons of said keypad further comprise:

a fifth push-button corresponding to item E); and a sixth push-button corresponding to item F).

17. The electronic system according to claim 16, wherein:

said displacement device further comprises a lateral displacement device for laterally displacing the printing plate on the plate cylinder in the lateral direction of the cylinder to adjust a lateral alignment of the printing plate.

18. The electronic system according to claim 17, wherein:

said data input unit is further configured for receiving data representative of:

a distance value corresponding to the deviation of said at least two points in solely a substantially lateral direction, the deviation in solely a substantially lateral direction comprising one of:

G) a deviation in a first lateral direction of said at least two points; and

H) a deviation in a second lateral direction of said at least two points, the second lateral direction being substantially opposite to the first lateral direction;

said pre-programmed calculation algorithms further comprise algorithms corresponding to items: G) and H);

said control console is further configured for selecting a deviation corresponding to one of items: G) and H) for directing the computer processor unit in determining respective adjustment signals for adjusting the plate cylinder;

said signal generator is further configured to produce an electronic signal corresponding to the selected one of items: G) and H);

said monitoring device is further configured for evaluating said produced electronic signal to determine the one of items: G) and H) selected, and controlling operation of said computer processor unit on the basis of the selected one of items: G) and H);

said keypad is further configured for selecting one of the items: G) and H) for directing the computer processor unit in determining respective adjustment signals for adjusting said displacement device; and said at least four push-buttons of said keypad further comprise:

a seventh push-button corresponding to item G); and an eighth push-button corresponding to item H).

19. The electronic system according to claim 18, wherein said eight push-buttons are disposed generally in the shape of a square, the square having four corners thereof, with one of said push-buttons disposed in each of the four corners, and one of said push-buttons disposed between each pair of adjoining corners, and said push-buttons forming an upper row, a middle row below the upper row, and a bottom row below the middle row, and a left column, a middle column to the right of the left column and a right column to the right of the middle column, wherein:

the upper left push-button is said first push-button;

the upper middle push-button is said fifth push-button;

the upper right push-button is said third push-button;

the middle left push-button is said seventh push-button;

the middle right push-button is said eighth push-button;

the lower left push-button is said second push-button;

the lower middle push-button is said sixth push-button; and the lower right push-button is said fourth push-button.

20. The electronic system according to claim 19, further comprising:

a monitoring apparatus for monitoring movement of said displacement device to indicate the degree of displacement achieved;

a display device;

said display device for displaying instructions for inputting data and visually depicting inputted values; and said data input unit further comprising at least one of:

a keyboard for typing data;

an additional keypad for typing data; and sensor apparatus for sensing positions of said at least two points.

* * * * *

UNITED STATES PATENT AND TRADEMARK OFFICE

CERTIFICATE OF CORRECTION

PATENT NO. : 5,649,484

DATED : July 22, 1997

INVENTOR(S) : Reinhard BROGHAMMER and Gregor FLADE

It is certified that error appears in the above-identified patent and that said Letters Patent is hereby corrected as shown below:

On the title page, add the following new section [30] after the section 'Related U.S. Application Data':

--[30] Foreign Application Priority Data
30 April 1993 [DE] Germany 43 14 228. --.

In column 11, line 66, after the first occurrence of 'and', delete "d" and insert --$d_{1-3}$--.

Signed and Sealed this

Tenth Day of February, 1998

Attest:

Bruce Lehman

BRUCE LEHMAN

Attesting Officer

Commissioner of Patents and Trademarks